US009605486B2

(12) United States Patent
Burhan et al.

(10) Patent No.: US 9,605,486 B2
(45) Date of Patent: Mar. 28, 2017

(54) ROLLING CUTTER WITH CLOSE LOOP RETAINING RING

(71) Applicant: Smith International, Inc., Houston, TX (US)

(72) Inventors: Yuri Burhan, Spring, TX (US); Jibin Shi, Spring, TX (US); Chen Chen, Houston, TX (US); Youhe Zhang, Spring, TX (US)

(73) Assignee: Smith International, Inc., Houston, TX (US)

( * ) Notice: Subject to any disclaimer, the term of this patent is extended or adjusted under 35 U.S.C. 154(b) by 596 days.

(21) Appl. No.: 13/972,465

(22) Filed: Aug. 21, 2013

(65) Prior Publication Data

US 2014/0054094 A1 Feb. 27, 2014

Related U.S. Application Data

(60) Provisional application No. 61/794,580, filed on Mar. 15, 2013, provisional application No. 61/712,794,
(Continued)

(51) Int. Cl.
*E21B 10/633* (2006.01)
*E21B 10/50* (2006.01)
*E21B 10/627* (2006.01)

(52) U.S. Cl.
CPC ..... *E21B 10/50* (2013.01); *E21B 10/627* (2013.01); *E21B 10/633* (2013.01)

(58) Field of Classification Search
CPC ..... E21B 10/62; E21B 10/627; E21B 10/633; E21C 35/197; E21C 35/19
See application file for complete search history.

(56) References Cited

U.S. PATENT DOCUMENTS 3,499,685 A * 3/1970 Kniff ..... E21C 35/197 299/104
3,512,838 A * 5/1970 Kniff ..... E21C 35/19 299/104

(Continued)

FOREIGN PATENT DOCUMENTS

CN 2216137 Y 12/1995
CN 1146229 A 3/1997

(Continued)

OTHER PUBLICATIONS

International Search Report and Written Opinion issued in corresponding International Application No. PCT/US2013/051317; Dated Oct. 8, 2013 (14 pages).

(Continued)

*Primary Examiner* — Giovanna C Wright
(74) *Attorney, Agent, or Firm* — Osha Liang LLP

(57) ABSTRACT

A cutting element is disclosed that includes a sleeve, a rotatable cutting element, and at least one retaining ring. The sleeve has a first inner diameter and a second inner diameter, wherein the second inner diameter is larger than the first inner diameter and located at a lower axial position than the first inner diameter. The rotatable cutting element has an axis of rotation extending therethrough, a cutting face, a body extending axially downward from the cutting face, wherein the body has a shaft that is disposed within the sleeve, and a circumferential groove formed around an outer surface of the shaft. The at least one retaining ring is disposed in the circumferential groove and extends at least around the entire circumference of the shaft, wherein the at least one retaining ring protrudes from the circumferential groove, thereby retaining the rotatable cutting element within the sleeve.

22 Claims, 30 Drawing Sheets

Related U.S. Application Data filed on Oct. 11, 2012, provisional application No. 61/691,653, filed on Aug. 21, 2012.

(56) References Cited

U.S. PATENT DOCUMENTS

| | | | | |
|---|---|---|---|---|
| 3,690,728 | A * | 9/1972 | Krekeler | E21C 35/197 299/109 |
| 4,104,344 | A | 8/1978 | Pope et al. | |
| 4,247,147 | A * | 1/1981 | Rettkowski | E21C 35/197 175/354 |
| 4,288,248 | A | 9/1981 | Bovenkerk et al. | |
| 4,553,615 | A * | 11/1985 | Grainger | E21B 10/12 175/354 |
| 4,582,364 | A | 4/1986 | deMey, III | |
| 4,684,176 | A * | 8/1987 | Den Besten | E21C 35/197 299/107 |
| 5,018,793 | A * | 5/1991 | Den Besten | E21C 35/197 299/107 |
| 5,127,923 | A | 7/1992 | Bunting et al. | |
| 5,415,462 | A | 5/1995 | Massa | |
| 5,678,645 | A | 10/1997 | Tibbitts et al. | |
| 5,906,245 | A | 5/1999 | Tibbitts et al. | |
| 2006/0006727 | A1* | 1/2006 | Frear | E21C 35/197 299/107 |
| 2006/0033379 | A1* | 2/2006 | Frear | E21C 35/197 299/107 |
| 2006/0261663 | A1* | 11/2006 | Sollami | E21C 35/197 299/104 |
| 2007/0205023 | A1* | 9/2007 | Hoffmaster | E21B 10/43 175/408 |
| 2008/0202819 | A1* | 8/2008 | Fader | E21C 35/18 175/401 |
| 2009/0205870 | A1* | 8/2009 | Smith | E21B 10/60 175/57 |
| 2009/0284069 | A1* | 11/2009 | Watson | E21C 35/197 299/10 |
| 2010/0218999 | A1 | 9/2010 | Jones et al. | |
| 2010/0219001 | A1 | 9/2010 | Shen et al. | |
| 2010/0314176 | A1 | 12/2010 | Zhang et al. | |
| 2011/0241407 | A1* | 10/2011 | Fader | E21C 35/197 299/29 |
| 2011/0284293 | A1 | 11/2011 | Shen et al. | |
| 2012/0073881 | A1 | 3/2012 | Shen et al. | |
| 2013/0169022 | A1* | 7/2013 | Monyak | E21C 35/197 299/79.1 |
| 2014/0339882 | A1* | 11/2014 | Hall | B28D 1/188 299/106 |

FOREIGN PATENT DOCUMENTS

| | | | |
|---|---|---|---|
| CN | 101248251 | A | 8/2008 |
| CN | 101255795 | A | 9/2008 |
| CN | 101842202 | A | 9/2010 |

OTHER PUBLICATIONS

Office Action issued in Chinese Patent Application No. 201380049452.2; Dated Nov. 30, 2015 (25 pages).

* cited by examiner

ROLLING CUTTER WITH CLOSE LOOP RETAINING RING

CROSS-REFERENCE TO RELATED APPLICATIONS

This application claims the benefit of U.S. Provisional Application No. 61/794,580 filed on Mar. 15, 2013, U.S. Provisional Application No. 61/712,794 filed on Oct. 11, 2012, and U.S. Provisional Application No. 61/691,653 filed on Aug. 21, 2012, all of which are herein incorporated by reference in their entirety.

BACKGROUND

Technical Field

Embodiments disclosed herein relate generally to cutting elements for drill bits or other cutting tools incorporating the same. More particularly, embodiments disclosed herein relate generally to rotatable cutting elements.

Background Art

Drill bits used to drill wellbores through earth formations generally are made within one of two broad categories of bit structures. Depending on the application/formation to be drilled, the appropriate type of drill bit may be selected based on the cutting action type for the bit and its appropriateness for use in the particular formation. Drill bits in the first category are generally known as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the second category are typically referred to as "fixed cutter" or "drag" bits. Drag bits, include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which is typically a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

An example of a prior art PDC bit having a plurality of cutters with ultra hard working surfaces is shown in FIGS. 1 and 2. The drill bit 100 includes a bit body 110 having a threaded upper pin end 111 and a cutting end 115. The cutting end 115 typically includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 2, a top view of a prior art PDC bit is shown. The cutting face 118 of the bit shown includes a plurality of blades 120, wherein each blade has a leading side 122 facing the direction of bit rotation, a trailing side 124 (opposite from the leading side), and a top side 126. Each blade includes a plurality of cutting elements or cutters generally disposed radially from the center of cutting face 118 to generally form rows. Certain cutters, although at differing axial positions, may occupy radial positions that are in similar radial position to other cutters on other blades.

A significant factor in determining the longevity of PDC cutters is the exposure of the cutter to heat. Exposure to heat can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. The thermal operating range of conventional PDC cutters is typically 700-750° C. or less.

As mentioned, conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

In conventional drag bits, PDC cutters are fixed onto the surface of the bit such that a common cutting surface contacts the formation during drilling. Over time and/or when drilling certain hard but not necessarily highly abrasive rock formations, the edge of the working surface on a cutting element that constantly contacts the formation begins to wear down, forming a local wear flat, or an area worn disproportionately to the remainder of the cutting element. Local wear flats may result in longer drilling times due to a reduced ability of the drill bit to effectively penetrate the work material and a loss of rate of penetration caused by dulling of edge of the cutting element. That is, the worn PDC cutter acts as a friction bearing surface that generates heat, which accelerates the wear of the PDC cutter and slows the penetration rate of the drill. Such flat surfaces effectively stop or severely reduce the rate of formation cutting because the conventional PDC cutters are not able to adequately engage and efficiently remove the formation material from the area of contact. Additionally, the cutters are typically under constant thermal and mechanical load. As a result, heat builds up along the cutting surface, and results in cutting element fracture. When a cutting element breaks, the drilling operation may sustain a loss of rate of penetration, and additional damage to other cutting elements, should the broken cutting element contact a second cutting element.

Additionally, the generation of heat at the cutter contact point, specifically at the exposed part of the PDC layer caused by friction between the PCD and the work material, causes thermal damage to the PCD in the form of cracks which lead to spalling of the polycrystalline diamond layer, delamination between the polycrystalline diamond and substrate, and back conversion of the diamond to graphite causing rapid abrasive wear. The thermal operating range of conventional PDC cutters is typically 750° C. or less.

Accordingly, there exists a continuing need for developments in improving the life of cutting elements.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting element assembly that includes a sleeve having a first inner diameter and a second inner diameter, wherein the second inner diameter is larger than the first inner diameter and located at a lower axial position than the first inner diameter. The cutting element also has a rotatable cutting element with an axis of rotation extending therethrough, a cutting face and a body extending axially downward from the cutting face, wherein the body has a shaft, and wherein the shaft is disposed within the sleeve, and a circumferential groove formed around an outer surface of the shaft. At least one retaining ring is disposed in the circumferential groove, wherein the at least one retaining ring extends at least around the entire circumference of the shaft, and wherein the at least one retaining ring protrudes from the circumferential groove, thereby retaining the rotatable cutting element within the sleeve.

In another aspect, embodiments disclosed herein relate to a cutting element assembly that includes a sleeve and a rotatable cutting element having an axis of rotation extending therethrough. The rotatable cutting element has a cutting face and a body extending axially downward from the cutting face, wherein at least a portion of the body is disposed within the sleeve. A circumferential groove is formed around an outer surface of the body, wherein the circumferential groove is located axially downward from the sleeve. At least one retaining ring is disposed in the circumferential groove, wherein the at least one retaining ring extends at least around the entire circumference of the body, and wherein the at least one retaining ring protrudes from the circumferential groove, thereby retaining the rotatable cutting element within the sleeve.

Other aspects and advantages of the disclosure will be apparent from the following description and the appended claims.

BRIEF DESCRIPTION OF DRAWINGS

Embodiments of the present disclosure are described with reference to the following figures. The same numbers are used throughout the figures to reference like features and components.

DETAILED DESCRIPTION

Embodiments disclosed herein relate generally to rotatable cutting elements and methods of retaining such rotatable cutting elements on a drill bit or other cutting tools. Rotatable cutting elements of the present disclosure, also referred to as rolling cutters herein, may be retained on fixed cutter drill bits using one or more retaining rings and a sleeve having multiple inner radii. Advantageously, retaining rings and the sleeves described herein allow a rolling cutter to rotate as it contacts the formation to be drilled, while at the same time retaining the rolling cutter on the drill bit.

Figure 1:
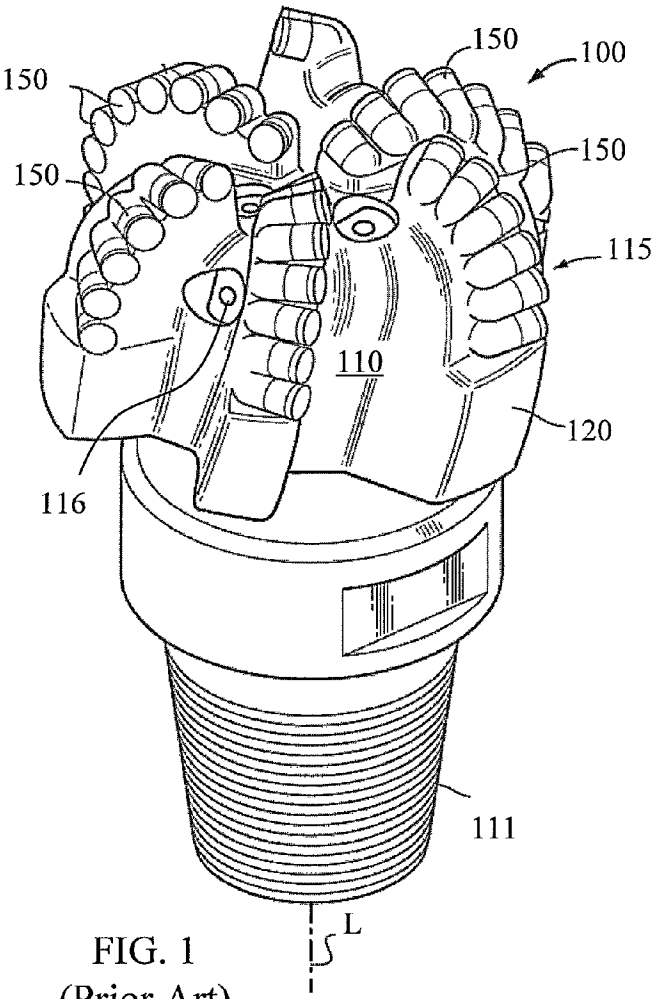
FIG. 1 (Prior Art)
FIG. 1 shows a side view of a conventional drag bit.
Figure 2:
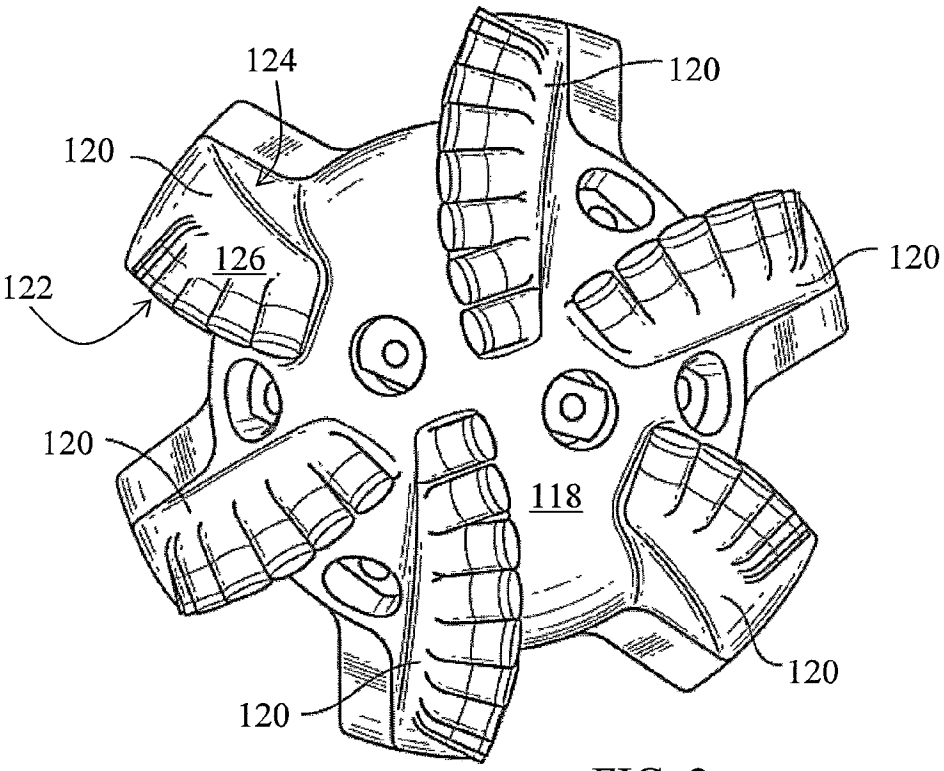
FIG. 2 (Prior Art)
FIG. 2 shows a top view of the conventional drag bit.
Figure 3:
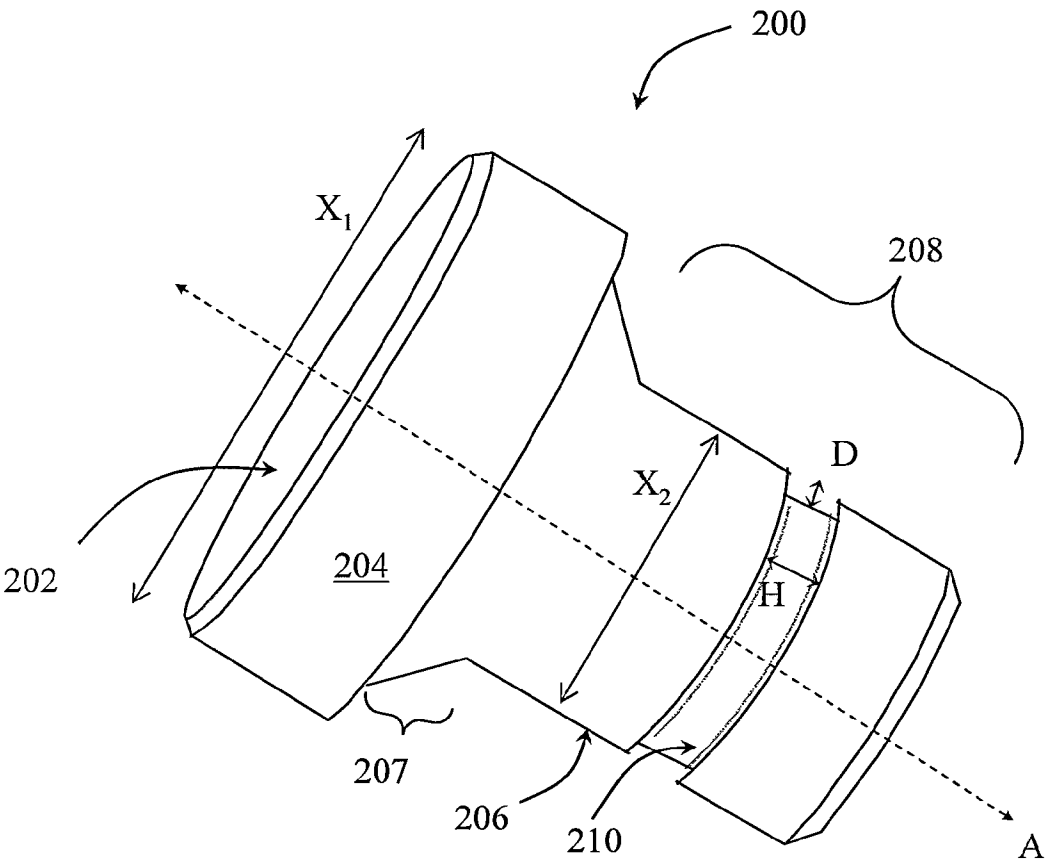
FIG. 3 shows a perspective view of a rotatable cutting element according to embodiments of the present disclosure.

FIG. 3 shows a rolling cutter 200 according to embodiments of the present disclosure. The rolling cutter 200 has a cutting face 202 and a body 204 extending axially downward from the cutting face 202 along an axis of rotation A. The body 204 has an outer surface 206 and a shaft 208. As shown, the shaft 208 has a diameter smaller than the diameter of the cutting face 202. Further, a circumferential groove 210 is formed in the outer surface 206 of the shaft 208. The circumferential groove 210 may have a height H that extends axially along the shaft 208 and a depth D that extends radially into the shaft 208. The height H of the circumferential groove may range, for example, from about 2% to about 50% of the axial height of the shaft. Further, the depth D of the circumferential groove may range, for example, from a lower limit of any of less than 1%, 2%, 5%, or 10% of the radius of the shaft to an upper limit of any of 2%, 5%, 10%, 20%, or greater than 30% of the radius of the shaft. According to embodiments of the present disclosure, the depth of the circumferential groove may vary or may be constant. For example, a circumferential groove may have a concave surface, wherein the depth of the circumferential groove increases toward the axial center of the circumferential groove. Alternatively, as shown in FIG. 3, a circumferential groove 210 may be formed from two side surfaces intersecting with a base surface, such that the depth D is constant across the height H of the circumferential groove 210 base surface.

The cutting face 202 may be formed of diamond or other ultra-hard material. For example, a diamond material may extend a thickness of about 0.06 inches to about 0.15 inches from the cutting face into the rolling cutter, across the entire cutting face to form a diamond cutting table (not shown). In other embodiments, a rolling cutter may have a diamond or other ultra-hard material table having a thickness ranging from about 0.04 to 0.15 inches. Further, the cutting face may have a chamfer formed around the outer circumference, wherein the chamfer is not considered when measuring the thickness or diameter of the cutting table.

Figure 5A:
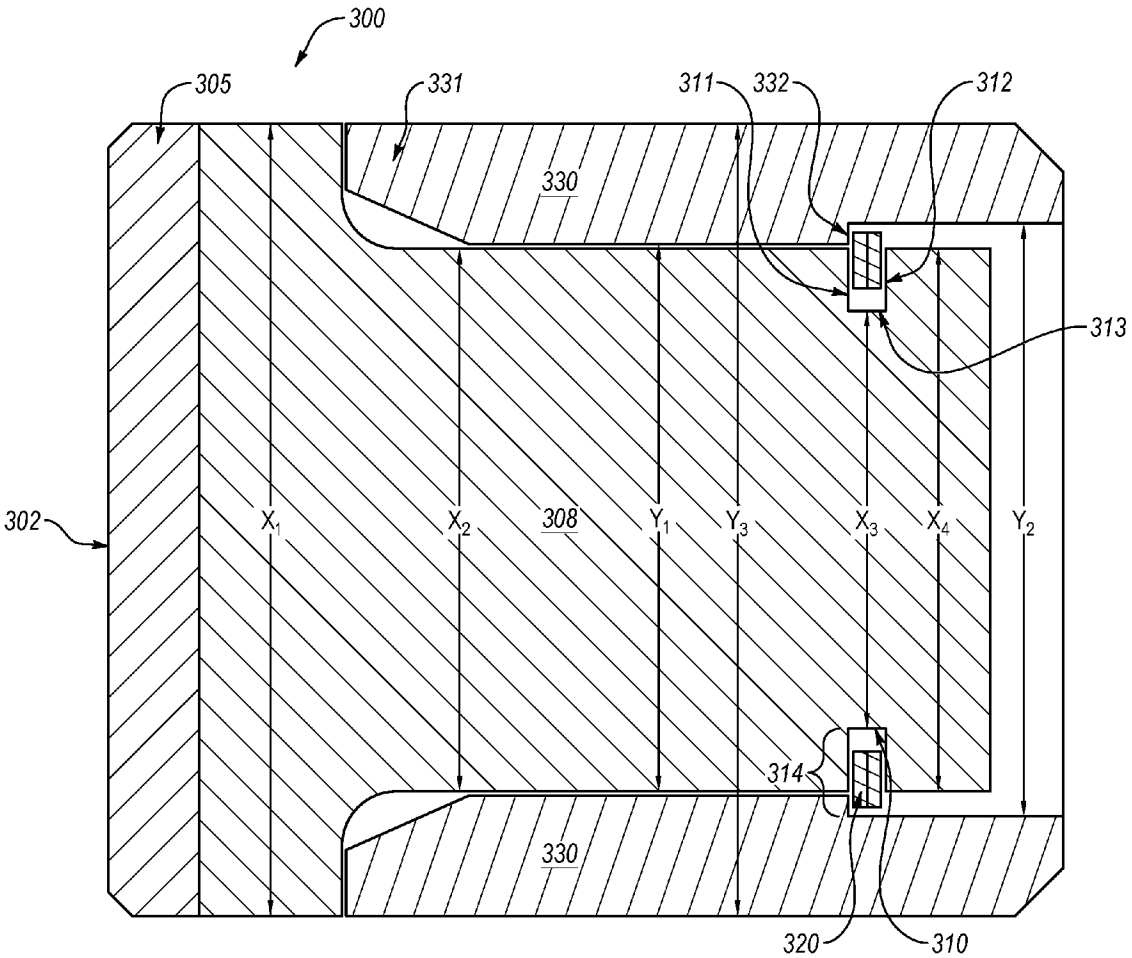
FIG. 5A-B show a cross-sectional views of a cutting element assembly according to embodiments of the present disclosure.
Figure 5B:
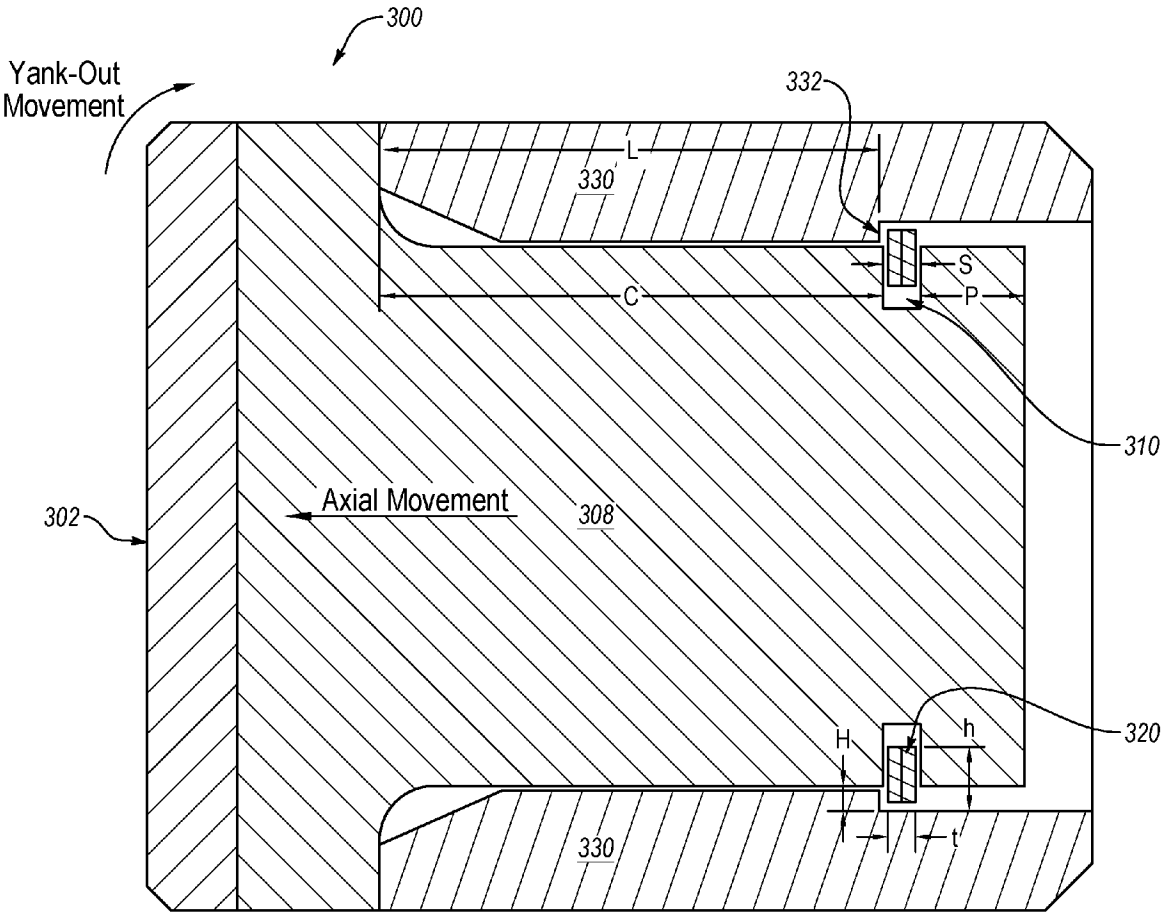

The rolling cutter 200 shown in FIG. 3 has a varying diameter along the axis of rotation A. As shown, the cutting face 202 has a first diameter $X_1$ and the shaft 208 has a second diameter $X_2$, smaller than the first diameter $X_1$. Further, the rolling cutter body 204 may have a transition 207 between the first diameter $X_1$ and the second diameter $X_2$, such as a gradually decreasing diameter. Alternatively, according to some embodiments, the change in diameter may be abrupt. For example, such as shown in FIG. 5 described below, a rolling cutter 300 may include, essentially, only two diameter sizes, $X_1$, $X_2$, wherein the cutting face and a portion of the body have a first diameter $X_1$ and the remaining portion of the body forming the shaft has a second diameter $X_2$ smaller than the first diameter, wherein changes in diameter occurring at the circumferential groove are not considered in the diameter measurements. Further, as used herein, measurements of diameter do not include chamfered edges. According to embodiments of the present disclosure, a rolling cutter 300 may have a first diameter $X_1$ that extends along the length of the rolling cutter from the cutting face a distance up to 0.2 inches in some embodiments, up to 0.23 inches in some embodiments, or greater than 0.25 inches in other embodiments.

Figure 4:
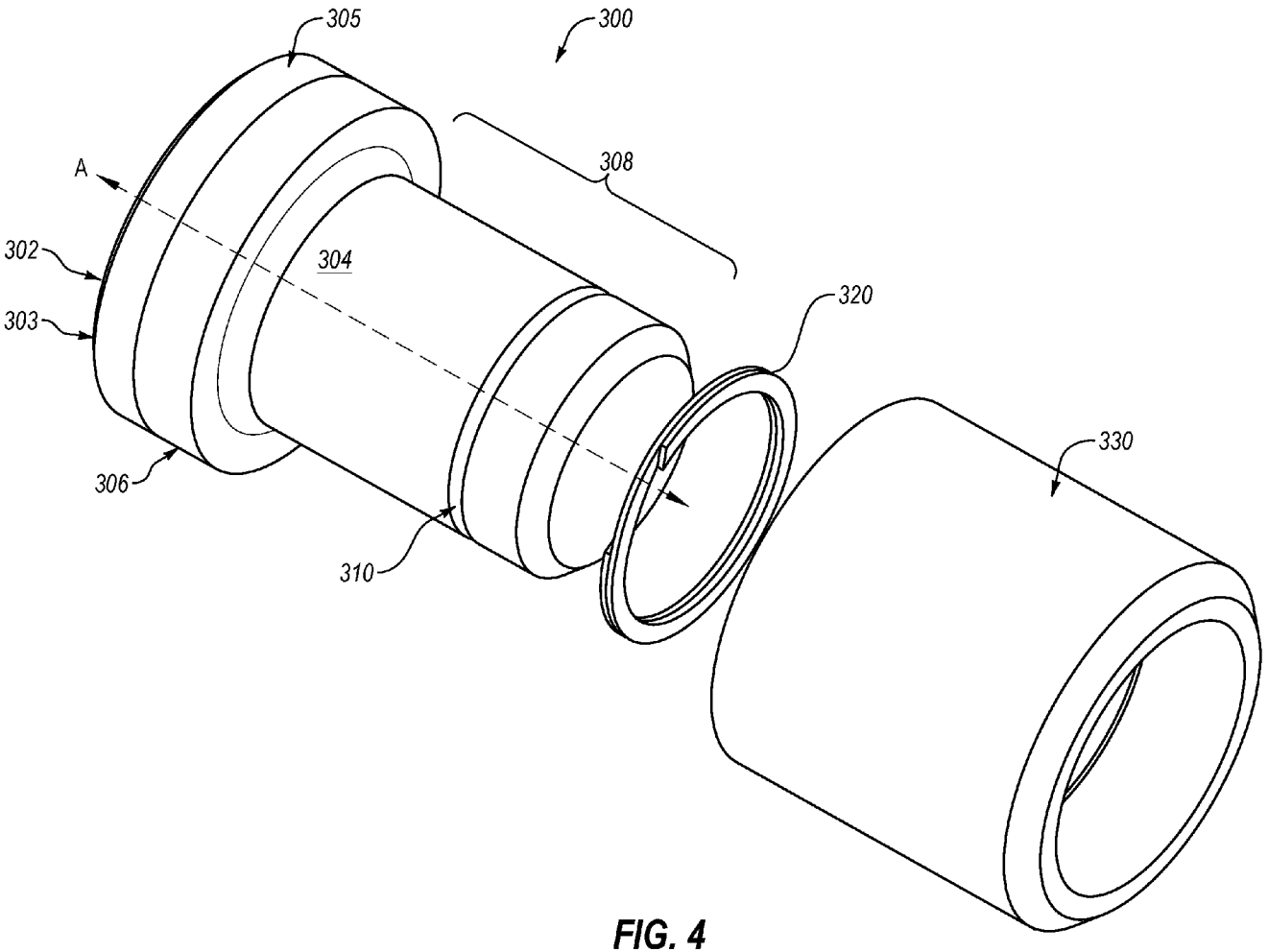
FIG. 4 shows an exploded view of a cutting element assembly according to embodiments of the present disclosure.

Referring now to FIGS. 4 and 5, a rotatable cutting element assembly according to embodiments of the present disclosure is shown. Particularly, an exploded view of the cutting element is shown in FIG. 4, including a rolling cutter 300, a retaining ring 320, and a sleeve 330. The rolling cutter 300 has an axis of rotation A extending longitudinally therethrough, a cutting face 302, and a body 304 extending axially downward from the cutting face 302. The body 304 has an outer surface 306 and a circumferential groove 310 formed therein. Particularly, the circumferential groove 310 is formed on a shaft 308 portion of the body 304 and extends a height axially along the shaft 308 and around the circumference of the shaft 308. Further, a cutting edge 303 is formed at the intersection of the cutting face 302 and the outer surface 306 of the rolling cutter 300. As shown, the cutting face 302 and cutting edge 303 may be formed from a diamond or other ultra-hard material table 305.

A cross-sectional view of the assembled cutting element is shown in FIG. 5, wherein the rolling cutter 300 is partially disposed within the sleeve 330, and wherein the retaining ring 320 is disposed between the rolling cutter 300 and the sleeve 330, within the circumferential groove 310. Particularly, the shaft 308 portion of the rolling cutter 300 is disposed within the sleeve 330. As shown, the portion of the rolling cutter 300 outside of the sleeve 330 has a first diameter $X_1$, and the shaft 308 has a second diameter $X_2$, wherein the first diameter $X_1$ is larger than the second diameter $X_2$. The sleeve 330 has a first inner diameter $Y_1$ and a second inner diameter $Y_2$, wherein the second inner diameter $Y_2$ is larger than the first inner diameter $Y_1$ and located at a lower axial position than the first inner diameter $Y_1$. The second diameter $X_2$ of the shaft 308 may be substantially equal to the first inner diameter $Y_1$ of the sleeve, so that the shaft may fit within the sleeve 330. As used herein, a substantially equal diameter includes a sufficient gap to allow the rolling cutter 300 to rotate within the sleeve 330. For example, the gap formed by difference between the shaft second diameter $X_2$ and the sleeve first inner diameter $Y_1$ may range from about 0.001 to 0.030 inches. Further, the sleeve 330 may have an outer diameter $Y_3$. As shown, the portion of the rolling cutter 300 remaining outside the sleeve 330 may have a first diameter $X_1$ that is substantially equal to the sleeve outer diameter $Y_3$, such that the assembled cutting element has a cylindrical shape. However, according to other embodiments, the rolling cutter first diameter $X_1$ be greater than or less than the sleeve outer diameter $Y_3$.

The sleeve 330 may have varying inner diameter sizes in addition to the first inner diameter $Y_1$ and the second inner diameter $Y_2$. For example, as shown in FIG. 5, a top end 331 of the sleeve 330 may have a gradually increasing inner diameter from the first inner diameter $Y_1$. According to some embodiments, a sleeve may also have an inner diameter smaller than the second inner diameter located axially downward from the second inner diameter and from the circumferential groove of an assembled cutting element. In such embodiments, a retaining ring may protrude from the circumferential groove into the space provided by the second inner diameter.

The circumferential groove 310 formed around the outer surface of the rolling cutter body may be axially positioned along the shaft 308 so that the circumferential groove 310 abuts the transition 332 between the sleeve first inner diameter $Y_1$ and second inner diameter $Y_2$. In other words, the circumferential groove 310 and the sleeve second inner diameter $Y_2$ both extend a distance in the same axial direction from the same axial position along the assembled cutting element. For example, as shown in FIG. 5, the circumferential groove has a first sidewall 311, a second side wall 312, and a base surface 313. The circumferential groove 310 extends a height axially along the shaft 308 from the first sidewall 311 to the second sidewall 312. The first sidewall 311 is located axially at the same position along the assembled cutting element as the transition 332 to the second inner diameter $Y_2$, thereby aligning the circumferential groove 310 with the transition 332 to the second inner diameter Y2 to create an interface surface 314 adjacent to the retaining ring 320. The retaining ring 320 may rotate around the interface surface 314, and the rolling cutter 300 may rotate within the sleeve 330, such that the transition surface 332 and first sidewall 311 maintain the interface surface 314 with the retaining ring 320.

As assembled, the cutting element has a retaining ring 320 disposed in the circumferential groove 310, wherein the retaining ring 320 extends at least around the entire circumference of the shaft 308. For example, in the embodiment shown in FIGS. 4 and 5, the retaining ring 320 may extend greater than 1.5 times around the circumference of the shaft 308. As shown in FIG. 5, the retaining ring 320 protrudes from the circumferential groove 310 to contact the second inner diameter $Y_2$ of the sleeve 330, thereby retaining the rolling cutter 300 within the sleeve 330. However, according to other embodiments, the retaining ring may protrude from the circumferential groove without contacting the second inner diameter to retain the rolling cutter within the sleeve.

The location of the transition 322 as well as the location of the groove 310 may be selected to limit the cutter's 300 axial movement with respect to the sleeve 330, as well as to minimize or reduce the tendency of the cutter 300 to yank out of the sleeve (by limiting the cutter axial movement). Thus, referring to FIG. 5B, the location c of the groove 310 on cutter 300 may be at least equal to the length L to the transition 332 on sleeve 330 but no more than 0.100 inches greater than the length L in an embodiment, or no more than 0.075, 0.050, or 0.025 inches in other embodiments, in order to lock the cutter within the groove as well as limit axial movement of the cutter relative to the groove. Further, the width s of the groove 310 may be at least equal to the thickness t of the ring 320, but no more than 0.100 inches greater than the thickness t in an embodiment, or no more than 0.075, 0.050, or 0.025 inches in other embodiments, to also limit axial movement of the cutter relative to the sleeve. Further, in one or more embodiments, the difference between c and L summed with the difference between s and t may be no more than 0.100 inches to further restrict axial movement, or no more than 0.075, 0.050, or 0.025 inches in other embodiments for even less axial movement.

Further, to ensure that the retaining ring can be properly installed between the sleeve and the cutter without weakening the retaining ring, the radial wall width h of the ring may be selected based on the cutter diameter $x_3$ at the maximum groove depth as well as the first inner diameter $Y_1$ of the sleeve, according to the following relationship: $x_3=Y_1-2h$, to ensure there is sufficient room in the groove 310 for the ring 320 to collapse into with it travels through the sleeve ID. Further, to ensure that the ring 320 is not plastically deformed when it travels through the sleeve ID, the ring's free (uncompressed OD, illustrated in FIG. 6B as f), the modulus of elasticity of the ring material E, and the yield strength of the material $S_y$ may also be considered in accordance with the following formula: $E\cdot h(f-Y_1)/((f-h)(Y_1-h))\leq S_y$.

Figure 24A:
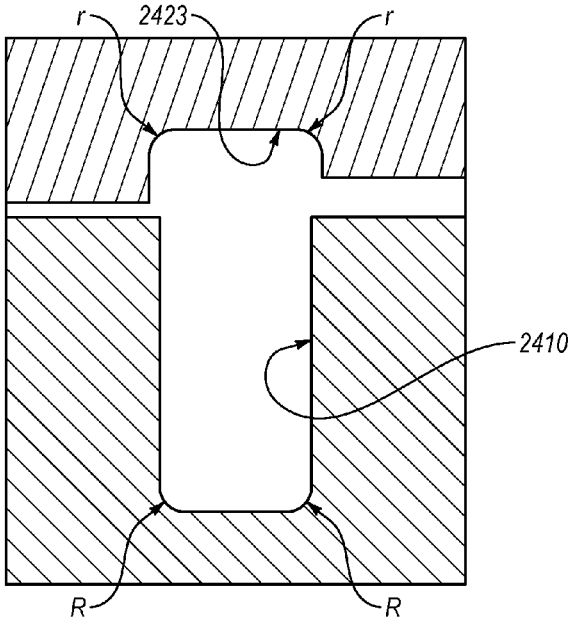
FIGS. 24A-B show cross-sectional views of a cutting element assembly according to embodiments of the present disclosure.
Figure 24B:
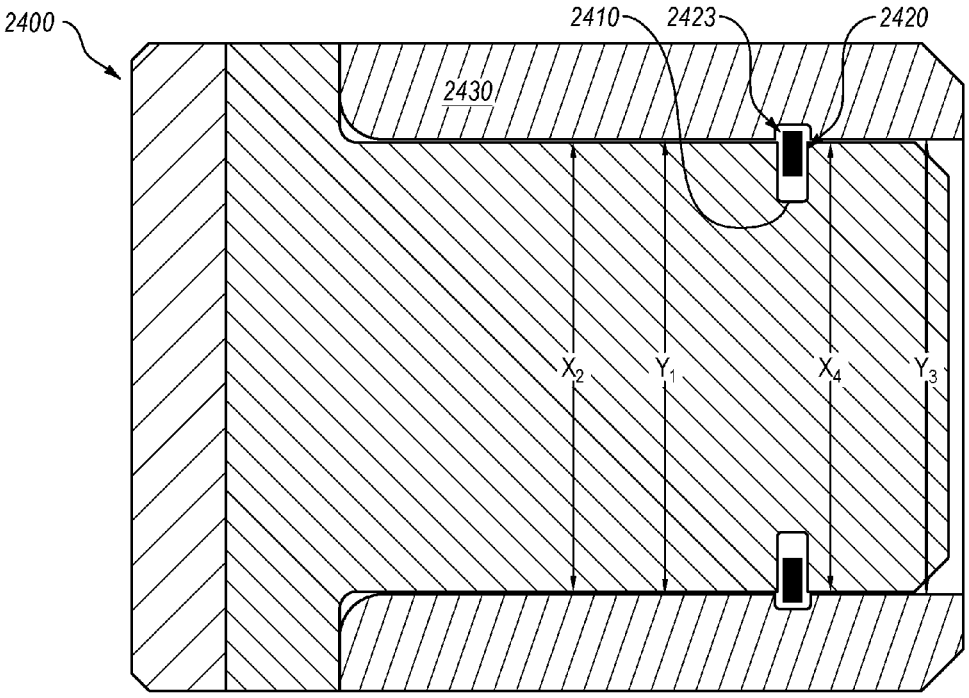
Figure 25:
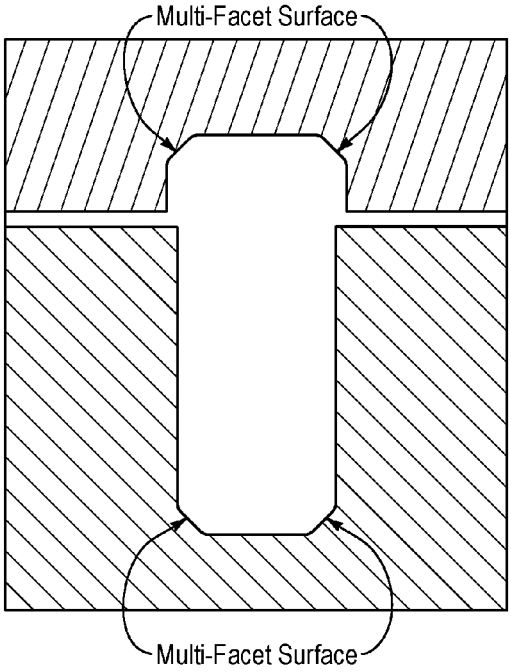
FIG. 25 shows a cross-sectional view of a cutting element assembly according to embodiments of the present disclosure.
Figure 26:
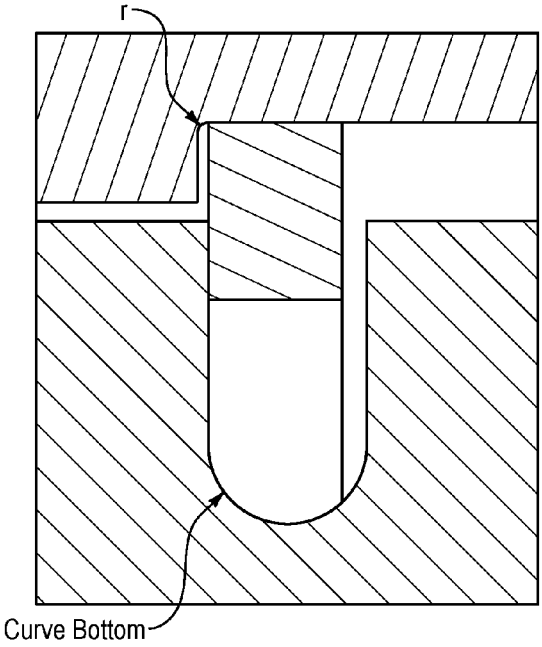
FIG. 26 shows a cross-sectional view of a cutting element assembly according to embodiments of the present disclosure.

When installed, the retaining ring 320 may touch the second inner diameter $Y_2$ of sleeve 330 in an uncompressed or slightly compressed state, i.e., the ring free (uncompressed) OD is at least equal to the second inner diameter $Y_2$ of the sleeve, which is greater than the first inner diameter $Y_1$. Further, the height H of the step of transition 322 may be selected based on the ring radial wall h such that H is at least one-tenth the ring radial wall h and no more than nine-tenths the ring radial wall h, i.e., $\frac{1}{10}h\leq H\leq\frac{9}{10}h$. In one or more embodiments, H may be at least two-, three-, four-, or five-tenths the ring radial wall h as a lower limit, and no more than five-, six, seven, or eight-tenths the ring radial wall h as an upper limit, where any lower limit may be used with any upper limit Further, it is also noted that in one or more embodiments, the distance p of the cutter 300 rearward of the groove 310 location is at least 0.030 inches, or at least 0.045 or 0.060 inches in other embodiments. Selection of the distance p may be based, in part, on the diameter $X_4$ of the cutter 300 rearward of the groove 310 location. For example, in some embodiments, the diameter $x_4$ of the cutter 300 rearward of the groove 310 location may be less than the diameter $X_2$ of the shaft 308, in which case a greater p may be selected. P and $X_4$ may be selected to minimize or avoid contact between the sleeve 330 at any points along its second inner diameter $Y_2$ and the cutter rearward of the groove. Such considerations may be particularly relevant when the sleeve includes a slotted groove therein for the ring, instead of a stepped transition, as illustrated in FIG. 24A-B. Specifically, as illustrated in FIG. 24A-B, a rotatable cutting element 2400 may be retained within sleeve 2430 by a ring 2420 that fits within groove 2423 such that the sleeve groove diameter $Y_3$ is greater than the first inner diameter $Y_1$ and the second inner diameter $Y_2$ (rearward of the groove location). Further, the second inner diameter $Y_2$ may be at least that of the first inner diameter $Y_1$, and similarly, the cutter shaft diameter $x_2$ may be at least that of the shaft diameter $x_4$ rearward of groove 2410 in cutter 2400. As shown, the groove 2410 in the cutter 2400 and the groove 2423 in the sleeve have radiused transitions r, R in the corners thereof. In one or more embodiments, the sleeve radius r and the cutter radius R may each be at least 0.003 inches to minimize stress risers. Alternatively, the transitions may include multi-faceted surfaces (illustrated in FIG. 25) or a curved bottom (illustrated in FIG. 26) to minimize stress risers.

Figure 6A:
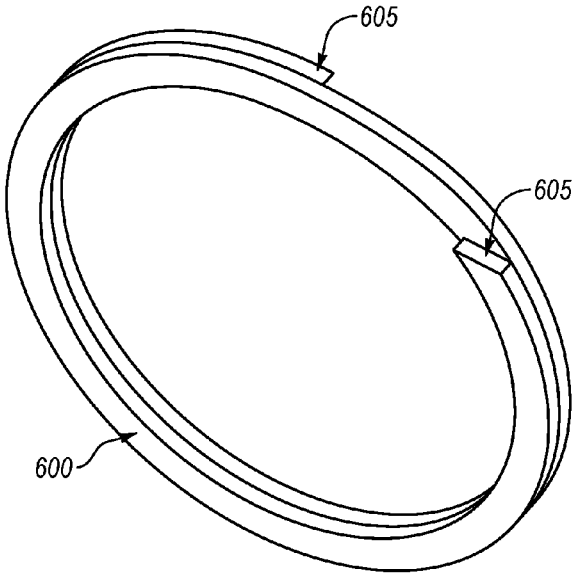
FIG. 6A-B shows perspective views of a retaining ring according to embodiments of the present disclosure.
Figure 6B:
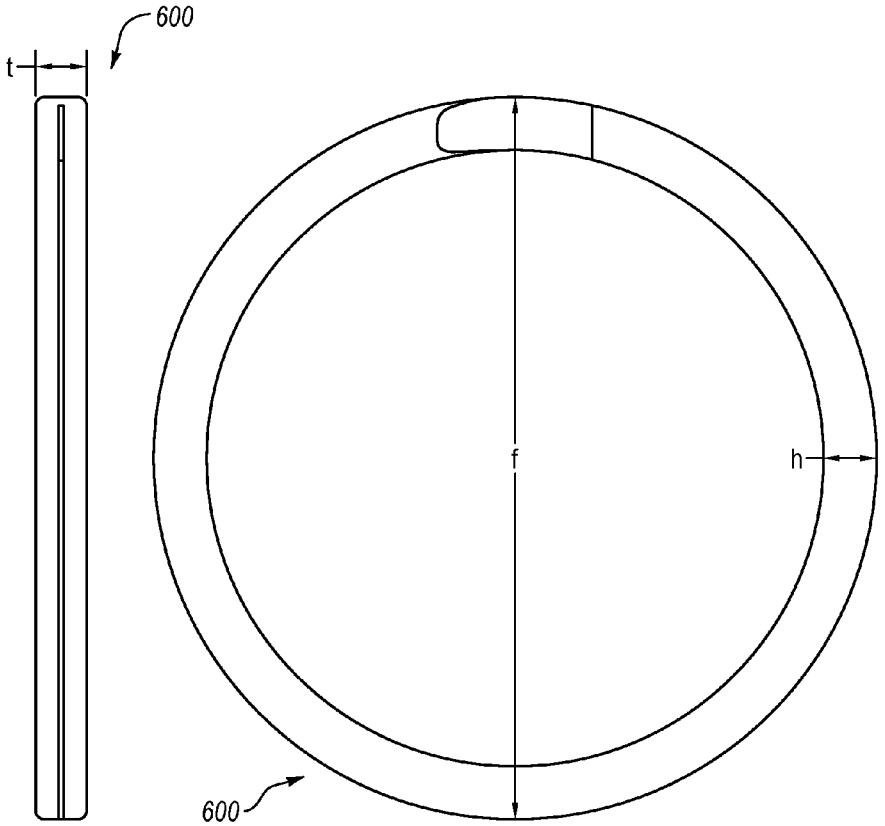

Retaining rings used in embodiments of the present disclosure may include closed loop rings. For example, referring to FIGS. 6A-B and 7, retaining rings according to embodiments of the present disclosure are shown. As shown in FIG. 6A, the retaining ring 600 may have the shape of a compressed spiral, wherein the retaining ring material extends greater than the circumference of the retaining ring to form a closed loop ring, and wherein each loop of the compressed spiral is adjacent to each other. The retaining ring 600 shown in FIG. 6A has approximately two loops forming the closed loop ring. However, according to embodiments disclosed herein, the retaining ring may extend the entire circumference of the closed loop ring, greater than the circumference of the closed loop ring, greater than 1.5 times the circumference of the closed loop ring, or greater than 2 times the circumference of the closed loop ring. Further, the retaining ring 600 may have unattached ends 605 such that the closed loop may be radially tightened, i.e., the diameter of the retaining ring 600 may be reduced, such as by extending the unattached ends 605 farther around the circumference of the retaining ring, or the loop may be radially expanded, i.e., the diameter of the retaining ring 600 may be increased, such as to expand the retaining ring over a larger diameter of the rolling cutter and pass the retaining ring over the larger rolling cutter diameter to the circumferential groove (having a relatively smaller diameter) formed therein. For example, when assembling cutting elements of the present disclosure, a retaining ring in expanded form may be disposed within a circumferential groove formed around a rolling cutter. As the rolling cutter and retaining ring are inserted into a sleeve, the retaining ring may be tightened, or compressed, (such as by extending the unattached ends a greater distance around the circumference of the retaining ring) so that the retaining ring fits within a smaller inner diameter of the sleeve. Once the retaining ring is inserted into a larger inner diameter of the sleeve, the retaining ring may then expand back to its original size, thereby preventing axial movement back through the smaller inner diameter of the sleeve and locking the rolling cutter within the sleeve. In one or more embodiments, the ring 600 may have a thickness t (shown in FIG. 6B) of at least 0.010 inches, or at least 0.015 or 0.020 inches in yet other embodiments.

Figure 7:
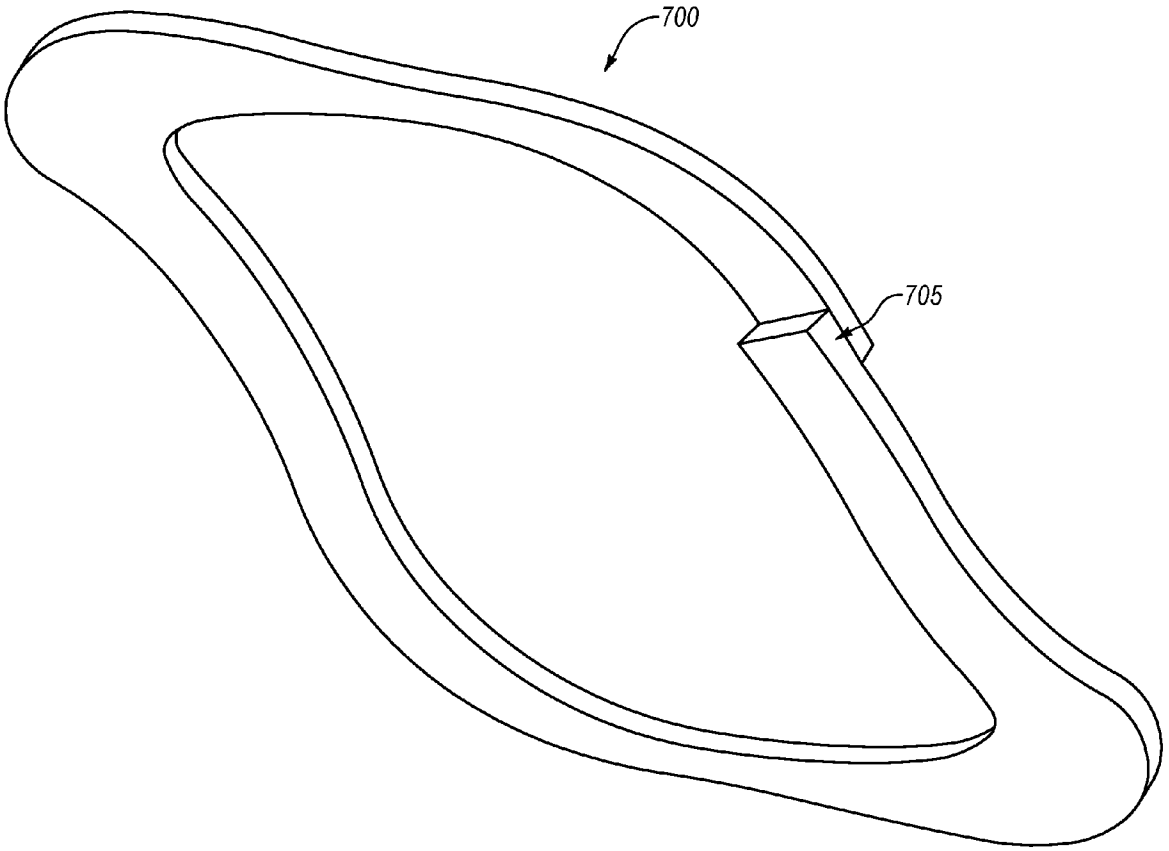
FIG. 7 shows a perspective view of a retaining ring according to embodiments of the present disclosure.

Further, retaining rings may be planar or non-planar. For example, FIG. 7 shows a non-planar retaining ring 700 according to embodiments of the present disclosure. As shown, the retaining ring material extends greater than the circumference of the retaining ring 700 to form a closed loop ring. In embodiments having retaining ring material extend greater than the circumference of the retaining ring, such as shown in FIG. 7, the retaining ring material ends 705 may overlap. As described above, the ends 705 may be unattached to provide changes in radial size, such as tightening and expanding the diameter size of the retaining ring 700 to fit and lock within a sleeve.

Figure 27:
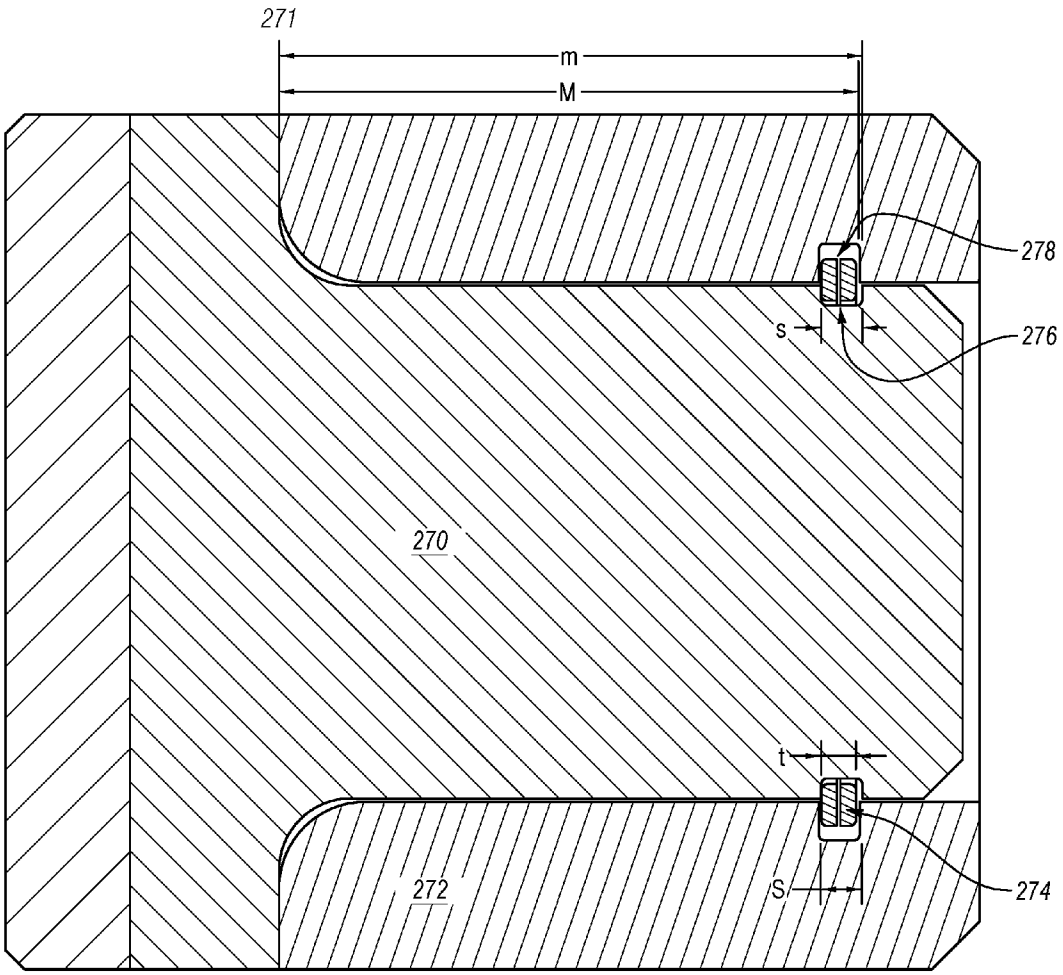
FIG. 27 shows a cross sectional view of a cutting element assembly according to embodiments of the present disclosure.
Figure 28:
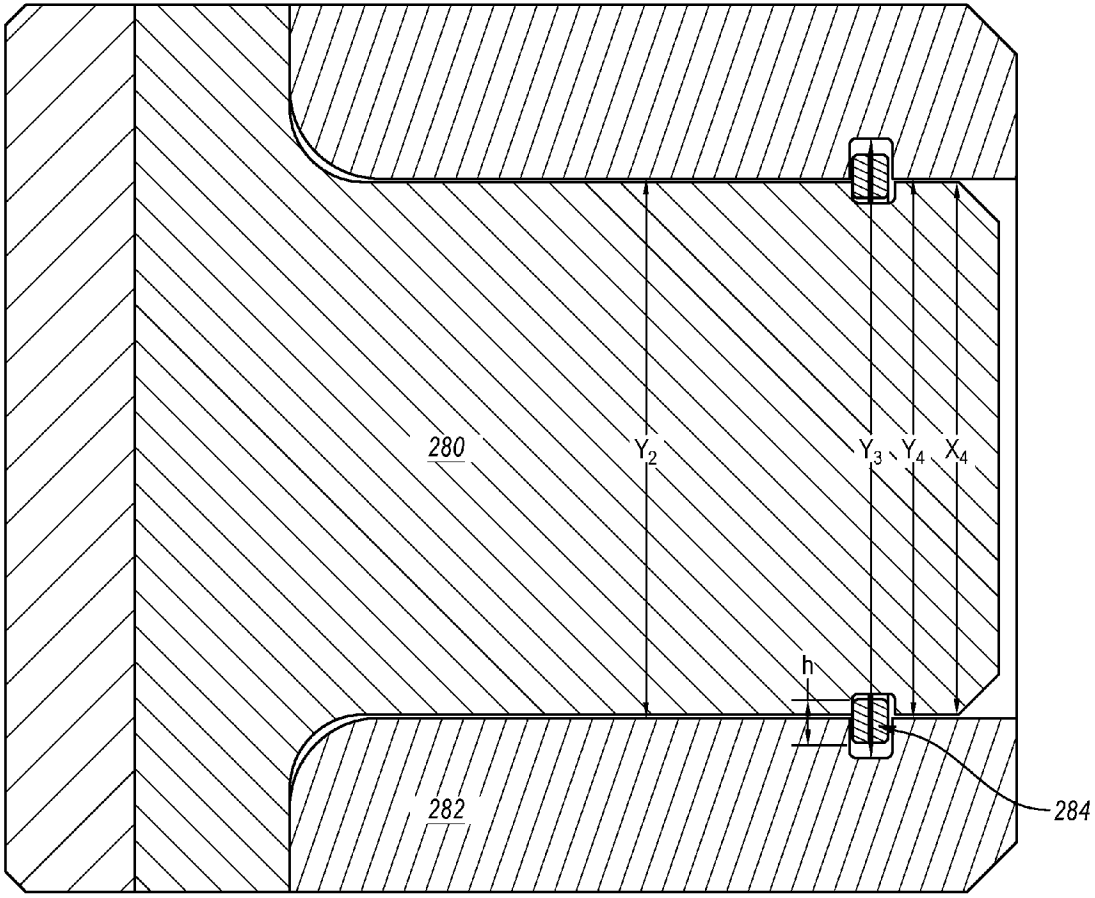
FIG. 28 shows a cross sectional view of a cutting element assembly according to embodiments of the present disclosure.
Figure 29:
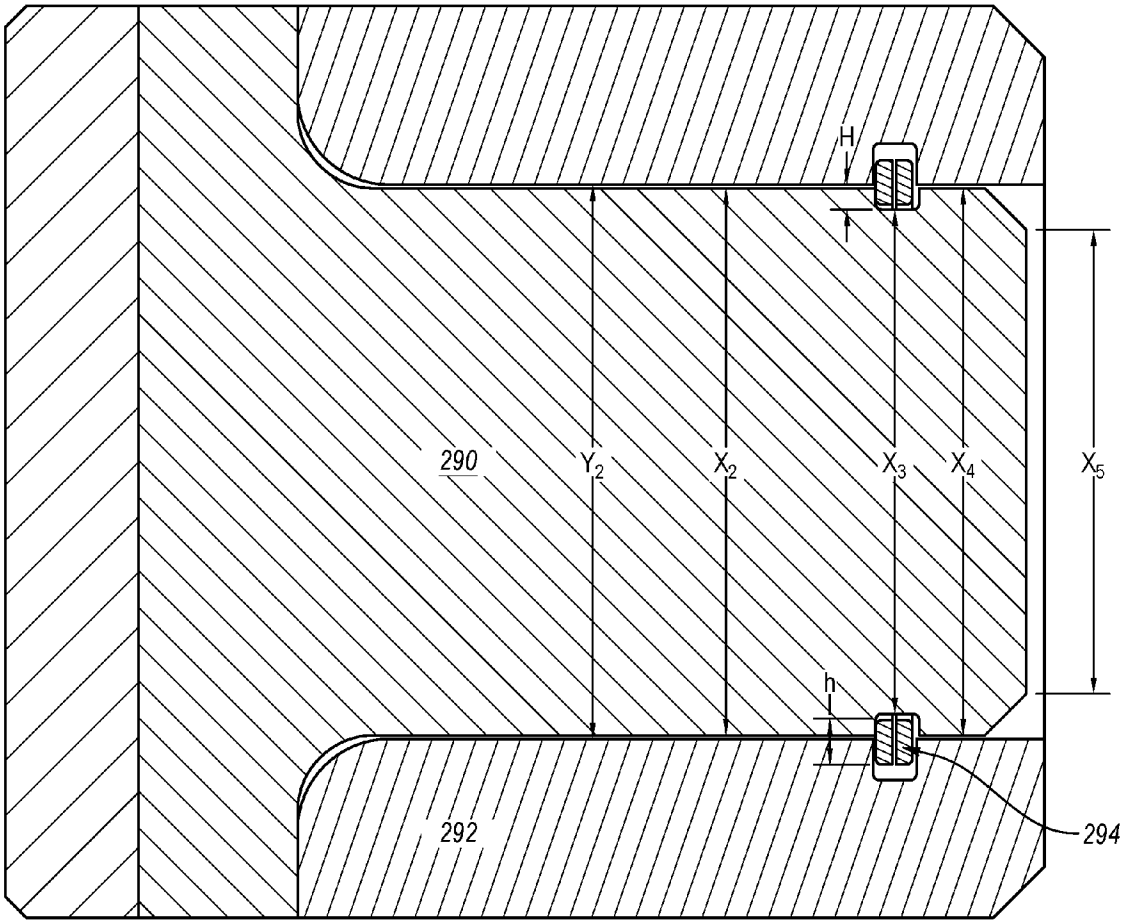
FIG. 29 shows a cross sectional view of a cutting element assembly according to embodiments of the present disclosure.

Retaining rings of the present disclosure may be retained within a circumferential groove formed between a rolling cutter and a sleeve. The circumferential groove may have dimensions to ensure that the rolling cutter is locked within the sleeve. FIGS. 27-29 show embodiments of cutting element assemblies of the present disclosure having dimensions to ensure enhanced retention.

Referring now to FIG. 27, a cross sectional view of a rolling cutter 270 retained within a sleeve 272 using a retaining ring 274 shows the retaining ring thickness t, a rolling cutter circumferential groove width s, a sleeve circumferential groove width S, the location of the back face of the rolling cutter circumferential groove m, and the location of the back face of the sleeve circumferential groove M. Particularly, the locations of the rolling cutter circumferential groove 276 and the sleeve circumferential groove 278 may be described by measuring the distance from the axial bearing 271 between the rolling cutter 270 and sleeve 272 to the back face (i.e., most axially distant surface from the axial bearing 271) of the rolling cutter circumferential groove 276 and the sleeve circumferential groove 278. According to embodiments of the present disclosure, the distance m (from the axial bearing 271 to the back face of the rolling cutter circumferential groove 276) may be greater than or equal to the distance M (from the axial bearing 271 to the back face of the sleeve circumferential groove 278). The distance m may be greater than or equal to the distance M to ensure the rolling cutter may pass through the retaining ring 274. Further, the sleeve circumferential groove width S may be greater than or equal to the retaining ring thickness t but less than or equal to 0.1 inches more than the retaining ring thickness t, represented by the relationship $t \leq S \leq t+0.1''$, to ensure that the sleeve circumferential groove 278 is wide enough for the ring thickness t and to limit cutter axial movement. A cutting element assembly according to some embodiments of the present disclosure may have the relationship $(m-s) \leq (M-t)$, wherein the distance m of the rolling cutter circumferential groove 276 less the rolling cutter circumferential groove width s (i.e., the distance measured from the axial bearing 271 to the side of the rolling cutter circumferential groove closest to the axial bearing) is less than or equal to the distance M of the sleeve circumferential groove 278 less the retaining ring thickness t. Cutting element assemblies according to embodiments of the present disclosure may have the relationship $(m-s) \leq (M-t)$ to prevent a load on the retaining ring when the rolling cutter is under an axial load.

Referring now to FIG. 28, a cross sectional view of a rolling cutter 280 retained within a sleeve 282 using a retaining ring 284 shows the retaining ring radial wall height h, the sleeve first inner diameter $Y_2$, the sleeve circumferential groove diameter $Y_3$, the sleeve second inner diameter $Y_4$, and the rolling cutter second diameter $x_4$ (i.e., the diameter of the rolling cutter adjacent the rolling cutter circumferential groove opposite from the rolling cutter cutting face). According to embodiments of the present disclosure, the relationships between the rolling cutter diameters, sleeve inner diameters, and retaining ring height may be designed to ensure that the retaining ring may fit within the circumferential groove and that the rolling cutter and retaining ring may fit within the sleeve. For example, the retaining ring 284 may have an outer diameter (in uncompressed form) f and retaining ring radial wall height h sized in relation to the sleeve first inner diameter $Y_2$, such that $(f-\frac{4}{5}h) \leq Y_2 \leq (f-\frac{1}{5}h)$, to ensure that the sleeve 282 has a first inner diameter $Y_2$ small enough to prevent the retaining ring 284 from being pulled out. Further, the cutting element assembly may have the relationship $Y_3 \geq (X_{4+2}h)$, i.e., a sleeve circumferential groove diameter $Y_3$ that is greater than or equal to the sum of the rolling cutter second diameter $x_4$ and twice the retaining ring radial wall height h, to ensure there is enough room in the sleeve circumferential groove for the retaining ring to expand once the rolling cutter travels through the retaining ring 284. In some embodiments, cutting element assemblies may have the relationship $(f-\frac{4}{5}h) \leq Y_4 \leq (f-\frac{1}{5}h)$ to ensure that the sleeve second inner diameter $Y_4$ is small and strong enough to hold and to support the retaining ring 284 inside the sleeve circumferential groove while the rolling cutter is being inserted into the sleeve 282.

Referring now to FIG. 29, a cross sectional view of a rolling cutter 290 retained within a sleeve 292 using a retaining ring 294 shows the retaining ring radial wall height h, the rolling cutter circumferential groove depth H, the sleeve first inner diameter $Y_2$, the rolling cutter first diameter $x_2$ (i.e., the diameter of the rolling cutter shaft near the rolling cutter cutting face), the rolling cutter diameter $x_3$ at the maximum circumferential groove depth, the rolling cutter second diameter $x_4$ (i.e., the diameter of the rolling cutter adjacent the rolling cutter circumferential groove opposite from the rolling cutter cutting face), and the rolling cutter diameter $x_5$ at the back face of the rolling cutter 290. The first diameter $x_2$ of the rolling cutter 290 may be less than or equal to the difference between the outer diameter f of the retaining ring 294 in uncompressed form and $\frac{1}{5}^{th}$ of the retaining ring radial wall height h, i.e., $x_2 \leq (f-\frac{1}{5}h)$. The sleeve first inner diameter $Y_2$ may be greater than or equal to the rolling cutter second diameter $x_4$, and the rolling cutter second diameter $x_4$ may be greater than or equal to the difference between the outer diameter f of the retaining ring 294 in uncompressed form and $\frac{4}{5}^{ths}$ of the retaining ring radial wall height h, i.e., $Y_2 \geq x_4 \geq (f-\frac{4}{5}h)$. The rolling cutter circumferential groove depth H may range between $\frac{1}{10}^{th}$ and $\frac{9}{10}^{ths}$ of the retaining ring radial wall height h, i.e., $(\frac{1}{10}h) \leq H \leq (\frac{9}{10}h)$, to provide a rolling cutter circumferential groove depth H large enough to retain the retaining ring 294, and thus, rolling cutter 290. The rolling cutter diameter $x_3$ at the maximum circumferential groove depth may be greater than or equal to the difference between the outer diameter f of the retaining ring 294 in uncompressed form and twice the retaining ring radial wall height h, i.e., $x_3 \geq (f-2h)$. The rolling cutter diameter $x_5$ at the back face of the rolling cutter 290 may be less than or equal to the difference between the outer diameter f of the retaining ring 294 in uncompressed form and twice the retaining ring radial wall height h, i.e., $x_5 \leq (f-2h)$, to ensure that the rolling cutter can be inserted into the retaining ring 294. Further, the transition between the rolling cutter second diameter $x_4$ and the rolling cutter diameter $x_5$ at the back face of the rolling cutter 290 may be gradual, such that the retaining ring 294 may pass and/or slide from the rolling cutter back face into the rolling cutter circumferential groove.

Figure 30:
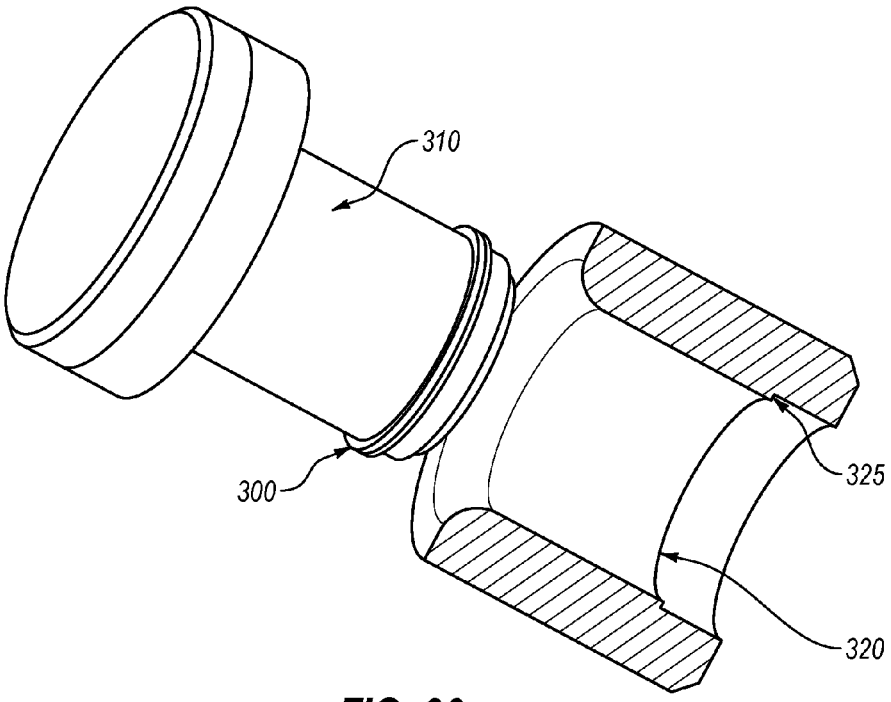
FIG. 30 shows an exploded view of a cutting element assembly according to embodiments of the present disclosure.
Figure 31:
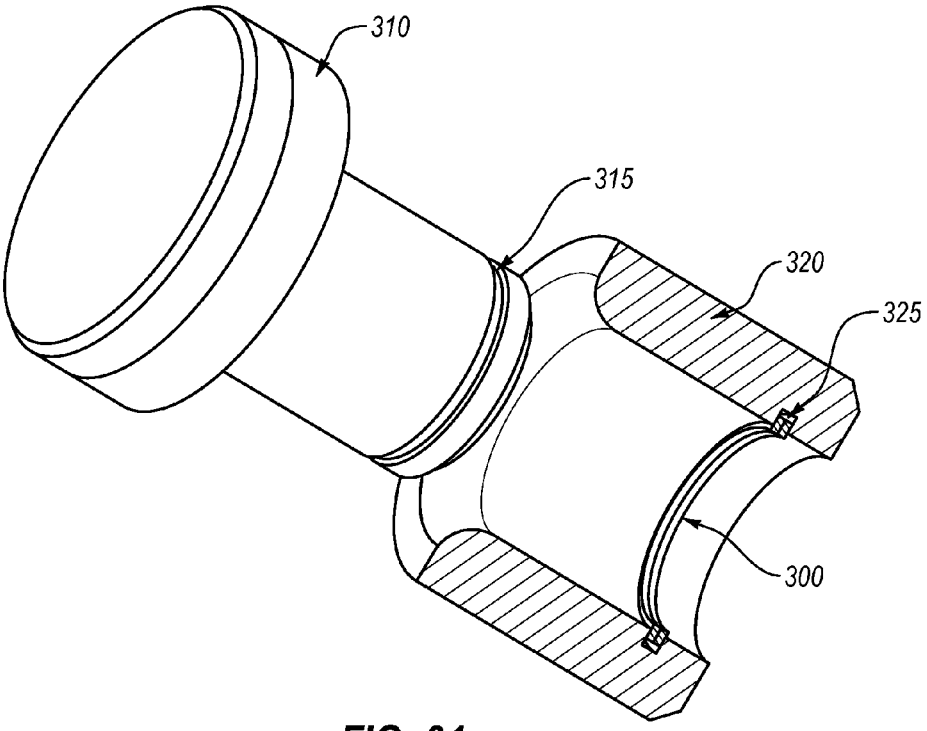
FIG. 31 shows an exploded view of a cutting element assembly according to embodiments of the present disclosure.

Cutting element assemblies of the present disclosure may be assembled by installing a retaining ring around a rolling cutter prior to installing the rolling cutter within a sleeve or by installing a retaining ring within a sleeve prior to installing the rolling cutter within the sleeve. For example, as shown in FIG. 30, a retaining ring 300 may be installed around a rolling cutter 310 within a circumferential groove formed around the shaft portion of the rolling cutter 310. The retaining ring 300 may be elastically deformed (e.g., squeezed) inside the circumferential groove as the retaining ring 300 and rolling cutter 310 is inserted into a sleeve 320. Once the retaining ring 300 reaches a circumferential groove or step 325 formed in the sleeve 320, the retaining ring 300 may expand or spring back to axially lock the rolling cutter 310 within the sleeve 320. Referring now to FIG. 31, a retaining ring 300 may be installed within a circumferential groove 325 formed around the inner surface of a sleeve 320. A rolling cutter 310 may then be inserted into the sleeve 320 and through the installed retaining ring 300. As the rolling cutter 310 is inserted, the retaining ring 300 may elastically deform (e.g., expand) around the rolling cutter 310. Once the retaining ring 300 reaches a circumferential groove 315 formed around the shaft portion of the rolling cutter 310, the retaining ring 300 may expand or spring back to axially lock the rolling cutter 310 within the sleeve 320.

Figure 32:
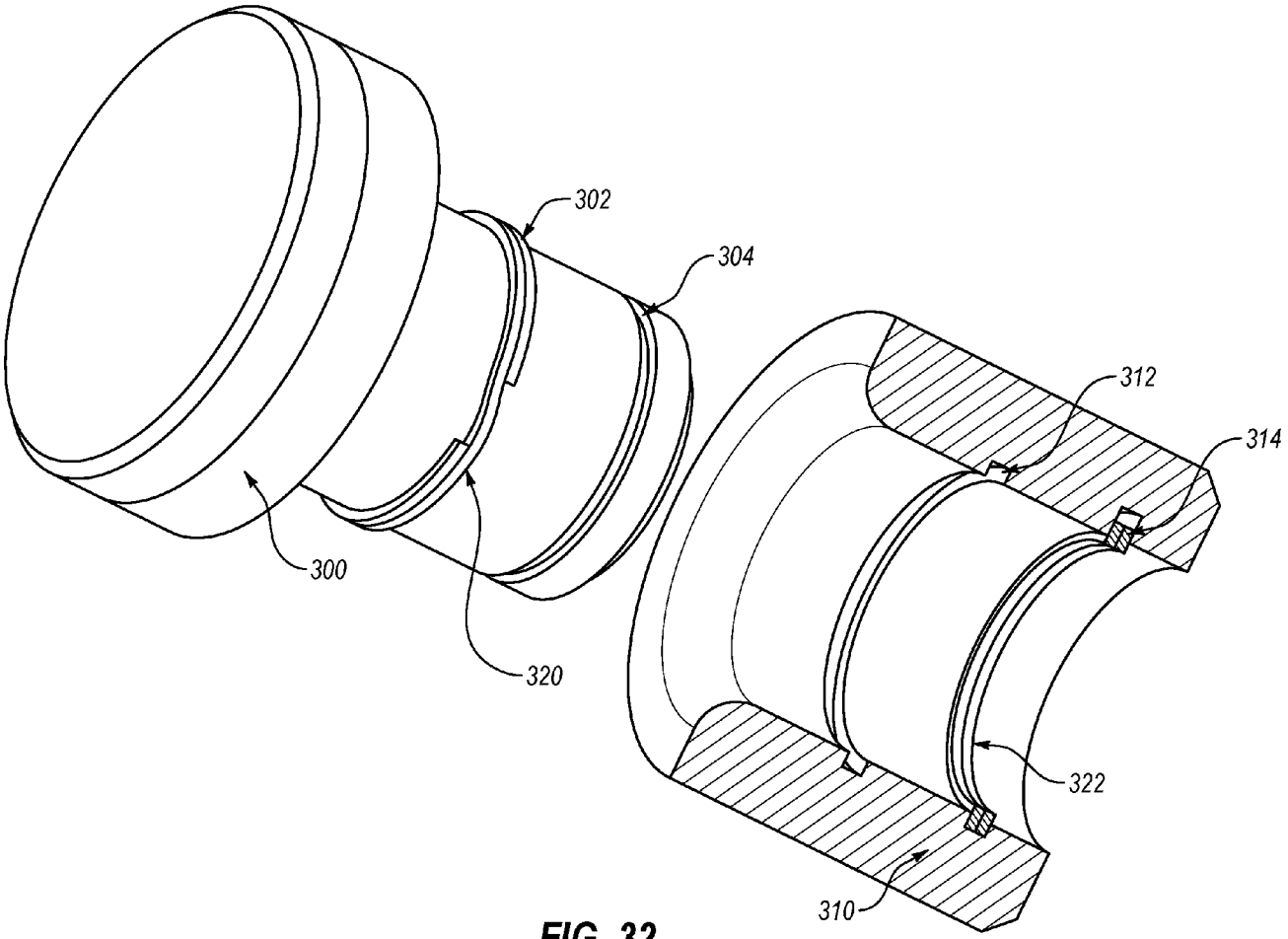
FIG. 32 shows an exploded view of a cutting element assembly according to embodiments of the present disclosure.
Figure 33:
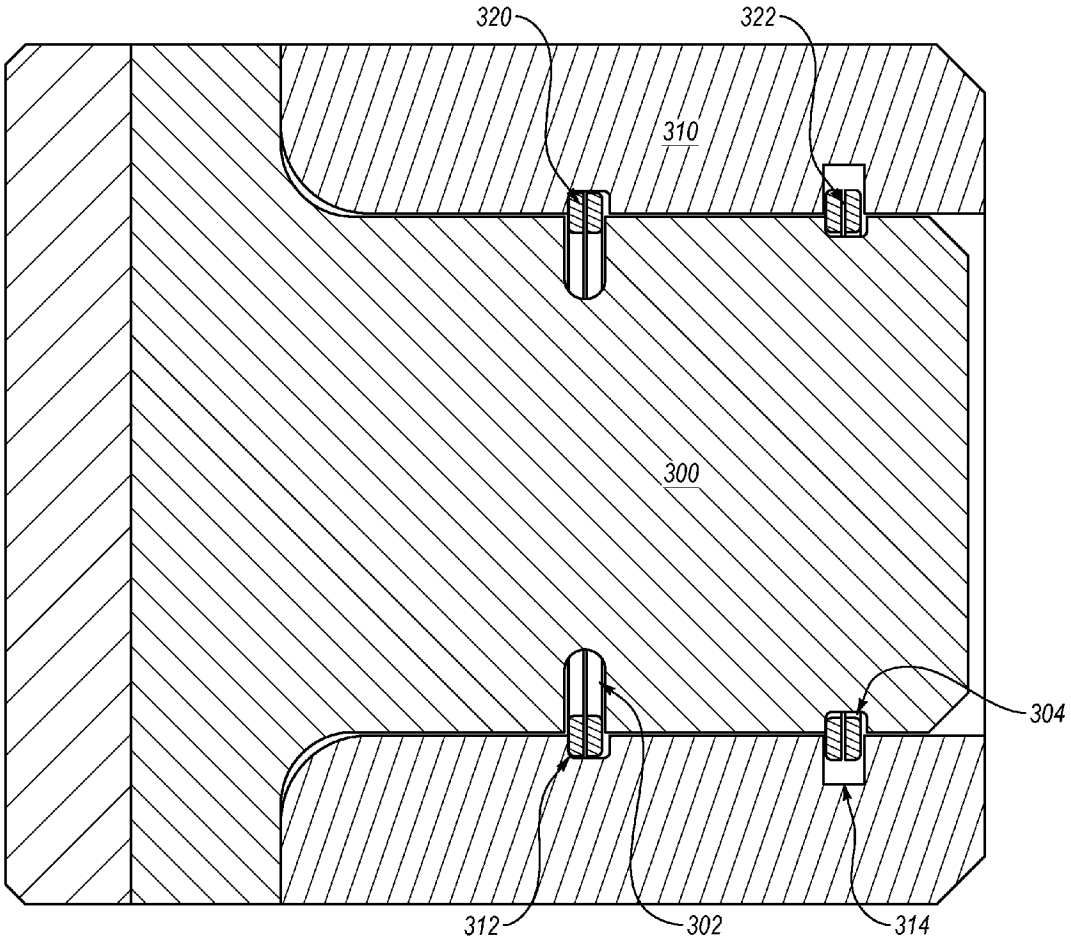
FIG. 33 shows a cross sectional view of a cutting element assembly according to embodiments of the present disclosure.

Further, according to embodiments of the present disclosure, more than one retaining ring may be used to retain a rolling cutter within a sleeve. For example, FIGS. 32 and 33 show a perspective view and a cross sectional view, respectively, of a cutting element assembly using two retaining rings to retain a rolling cutter within a sleeve according to embodiments of the present disclosure. As shown, a rolling cutter 300 may have two circumferential grooves 302, 304 formed around the shaft portion of the rolling cutter 300, and a sleeve 310 may have two corresponding circumferential grooves 312, 314 formed around the inner surface of the sleeve 310. Retaining rings 320, 322 may be disposed between each corresponding pair of circumferential grooves 302, 312 and 304, 314. According to embodiments of the present disclosure, a cutting element assembly using two retaining rings may be assembled by installing a first retaining ring 320 (axially closer to the diamond table) in a first circumferential groove 302 around the rolling cutter 300 (for example, as shown in FIG. 30) and installing a second retaining ring 322 (axially closer to the bottom face of the rolling cutter) in a second circumferential groove 314 formed in the sleeve 310 (for example, as shown in FIG. 31. The rolling cutter 300 having the first retaining ring 320 installed thereon may be inserted into the sleeve 310 having second retaining ring 322 installed therein.

According to embodiments of the present disclosure, retaining rings may be made of, for example, cermets, metals, or composite materials. For example, retaining ring material may include carbides, nitrides, borides, and/or materials including ultra hard materials, such as diamond or cubic boron nitride. In other examples, retaining ring material may include metal alloys including, for example, carbon steel, stainless steel, aluminum, titanium, austenitic nickel-chromium-based superalloys, or beryllium copper alloys. It is also envisioned that the ring may be non-metallic (such as polymeric or carbon fiber based). One or more embodiments may incorporate a coating or surface treatment (such as heat treatment or carburization) to reduce or prevent corrosion and/or to increase the wear resistance and surface hardness. The selection of the materials may be based, in part on the desired properties as well as the desired dimensions of the ring and cutter assembly components. Specifically, in one or more embodiments, it may be desirable for the ring to have a thrust load capacity based on ring shear of at least 500 pounds, or at least 1000, 1500, 2000, or 2500 pounds in yet other embodiments. Further, the allowable thrust load of the ring will be based on the sleeve diameter at the ring location ($Y_1$ shown in FIG. 5A, for example), ring thickness t, shear strength $S_s$ in the following relationship $P_r \geq D \cdot t \cdot S_s \cdot \pi$.

Retaining ring material may be in the form of a wire, which may be wound more than a single turn to form a closed loop ring, wherein the retaining ring material has unattached ends. Alternatively, retaining ring material may be cast or machined into a closed loop ring, or may have attached ends. Various forms of retaining rings according to embodiments of the present disclosure are described below with reference to assembled cutting elements.

Figure 8:
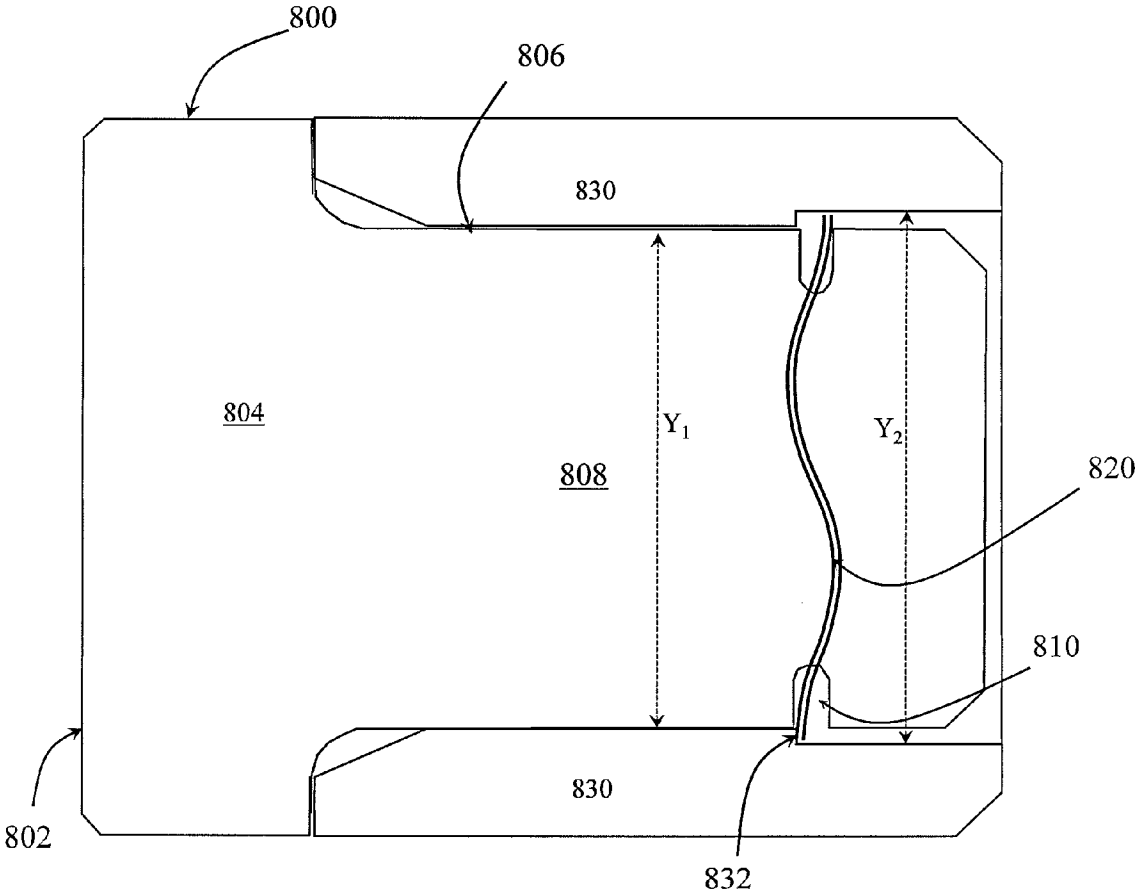
FIG. 8 shows a cross-sectional view of a cutting element according to embodiments of the present disclosure.

Referring now to FIG. 8, a side view of an assembled cutting element according to embodiments of the present disclosure is shown. The cutting element has a rolling cutter 800 disposed within a sleeve 830 and a retaining ring 820 disposed between the rolling cutter 800 and the sleeve 830 within a circumferential groove 810. The rolling cutter 800 has a cutting face 802 and a body 804 extending axially from the cutting face 802. The body 804 has a shaft 808, wherein the shaft 808 is disposed within the sleeve 830 and the remaining portion of the body 804 is outside the sleeve 830. The circumferential groove 810 is formed in the outer surface 806 of the shaft 808. Further, the sleeve 830 has a first inner diameter $Y_1$ and a second inner diameter $Y_2$, wherein the second inner diameter $Y_2$ is larger than the first inner diameter $Y_1$.

The transition 832 from the first inner diameter $Y_1$ to second inner diameter $Y_2$ and the circumferential groove 810 are axially positioned in the assembled cutting element to align so that the retaining ring 820 may protrude from the circumferential groove 810 to contact the transition 832. Particularly, upon inserting the rolling cutter 800 and retaining ring 820 into the sleeve, the retaining ring 820 may protrude from the rolling cutter 800 a distance to rotatably contact the second inner diameter $Y_2$ of the sleeve 830, and prevent the rolling cutter 800 from sliding out of the sleeve 830. While the retaining ring may protrude to contact a larger inner diameter in the sleeve, the retaining ring (in uncompressed form) may be too large to fit through the smaller inner diameter in the sleeve, thereby retaining the rolling cutter within the sleeve. It is also envisioned that any of the retaining rings of the present disclosure need not be so large to contact the larger inner diameter, so long as it is larger than the smaller inner diameter in the sleeve.

Figure 9:
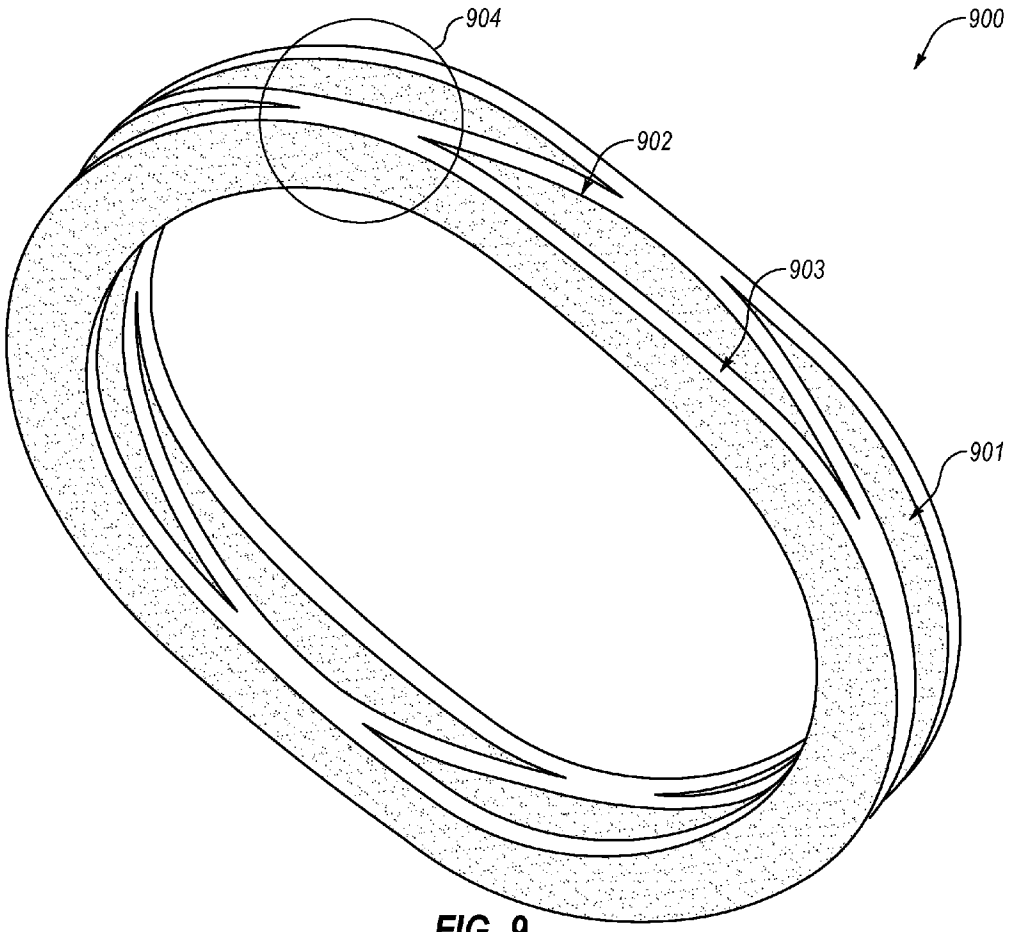
FIG. 9 shows a perspective view of a spring according to embodiments of the present disclosure.

As shown, a non-planar retaining ring 820 is disposed within the circumferential groove 810. The non-planar retaining ring 820 may have an undulating shape, such as shown in FIG. 7, which may act as a spring when axial force is applied to the rolling cutter 800, such as during drilling operations. Further, according to some embodiments of the present disclosure, two or more retaining rings may be attached or stacked together to form a spring. For example, referring to FIG. 9, a spring 900 may be made of three retaining rings 901, 902, 903 attached together, wherein at least one retaining ring is non-planar and at least one retaining ring is planar. As shown, retaining ring 902 is non-planar and is disposed between two planar retaining rings 901, 903. The retaining rings 901, 902, 903 may be welded together at crests 904 formed by the undulating shape of the non-planar retaining ring 902, which may act as a spring when axial force is applied to the rolling cutter. Although a combination of two planar and one non-planar retaining rings are shown in FIG. 9 forming the spring 900, other combinations may be used, such as attaching two or more non-planar retaining rings, attaching two or more non-planar and one planar retaining rings, or attaching two or more non-planar and two or more planar retaining rings. For example, in combinations using only non-planar retaining rings, the non-planar retaining rings may be attached at unsynchronized undulations to form a spring.

Figure 10:
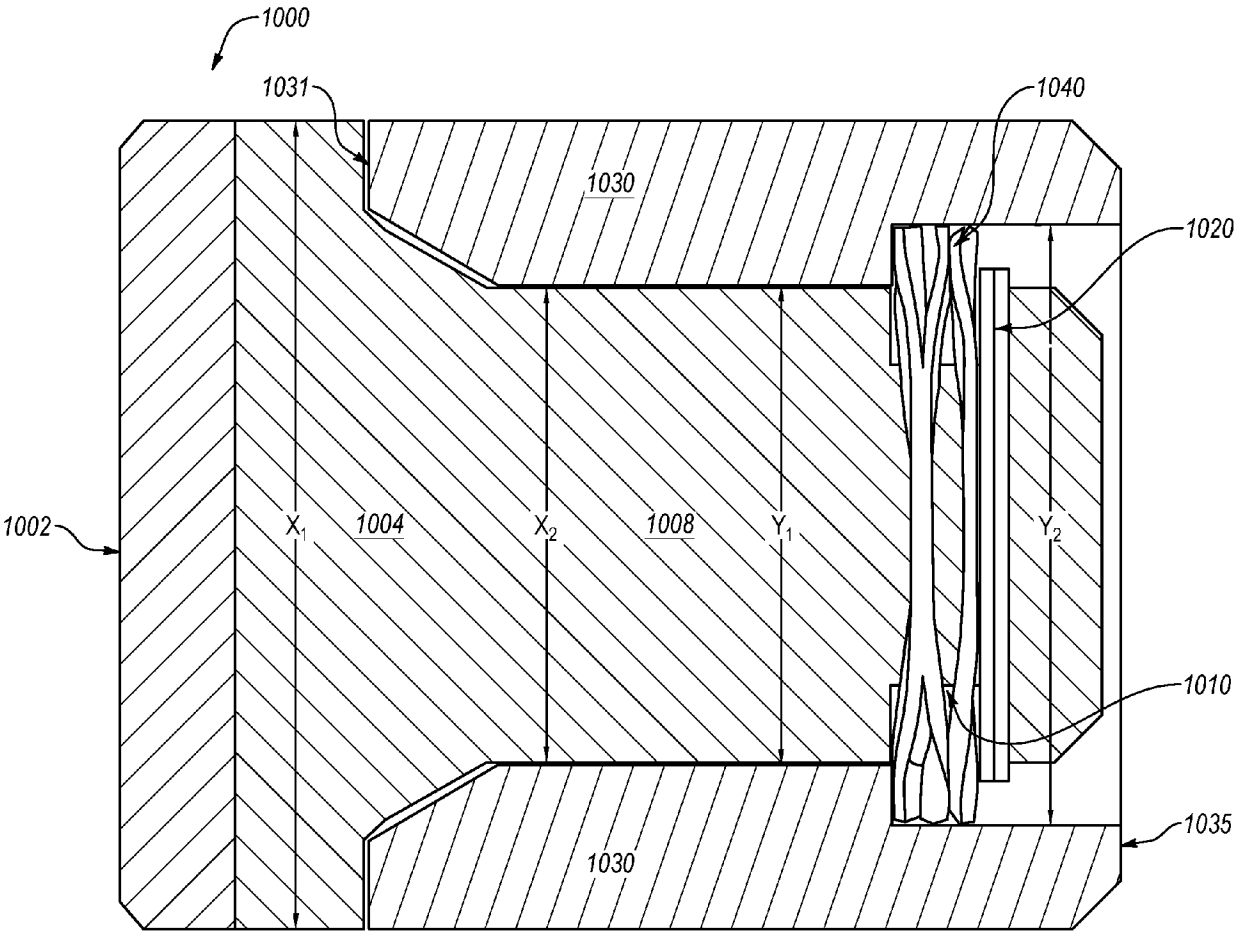
FIG. 10 shows a cross-sectional view of a cutting element according to embodiments of the present disclosure.

Referring now to FIG. 10, a cutting element having a spring according to embodiments of the present disclosure is shown. As shown, the cutting element has a rolling cutter 1000 partially disposed within a sleeve 1030, wherein a retaining ring 1020 and a spring 1040 are disposed between the rolling cutter 1000 and the sleeve 1030, within a circumferential groove 1010 formed around the outer surface of the rolling cutter 1000. As discussed above, a spring 1040 may be formed of one or more non-planar retaining rings. For example, the spring 1040 shown in FIG. 10 includes three non-planar rings attached together. However, in other embodiments, different types of springs may be used in combination with a retaining ring.

Figure 19:
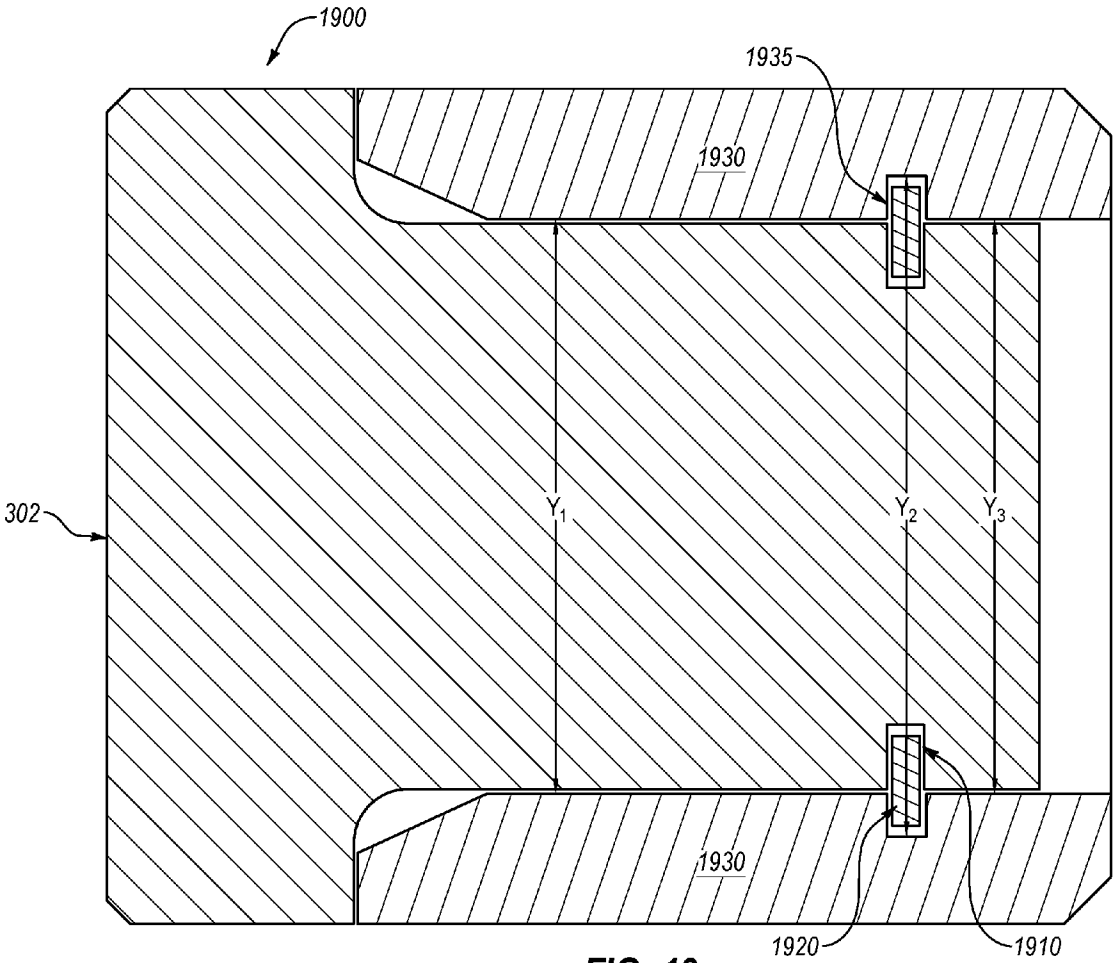
FIG. 19 shows a cross-sectional view of a cutting element assembly according to embodiments of the present disclosure.

The rolling cutter 1000 has a cutting face 1002 and a body 1004 extending axially therefrom, wherein the body 1004 includes a shaft 1008 having a diameter $X_2$ smaller than the diameter $X_1$ of the cutting face 1002. The sleeve 1030 has a first inner diameter $Y_1$ and a larger second inner diameter $Y_2$. Although the sleeve 1030 is shown as having the second inner diameter $Y_2$ axially extend from the first inner diameter $Y_1$ to the bottom 1035 of the sleeve, other embodiments may have a sleeve with a second inner diameter that extends downward, a partial axial distance towards the bottom of the sleeve. For example, a sleeve may have a second inner diameter (larger than the first inner diameter) extend from the first inner diameter to a third inner diameter, which is smaller than the second inner diameter, thereby forming a channel within the inner surface of the sleeve that may receive a protruding retaining ring. For example, as shown in FIG. 19, a rolling cutter 1900 according to embodiments of the present disclosure may be partially disposed within a sleeve 1930, wherein the sleeve has a first inner diameter $Y_1$, a second inner diameter $Y_2$ and a third inner diameter $Y_3$. As shown, the second inner diameter $Y_2$ is greater than both the first inner diameter $Y_1$ and the third inner diameter $Y_3$. The second inner diameter $Y_2$ may be positioned axially along the sleeve 1930 to form a matching channel 1935 with a circumferential groove 1910 formed in the rolling cutter 1900. A retaining ring 1920 may be disposed within the channel 1935 and the circumferential groove 1910 to retain the rolling cutter 1900 within the sleeve 1930. The groove 1910 may have any profile that is able to retain the retaining ring, such as semi-round circle or irregular geometries. Further, the third inner diameter $Y_3$ is shown as having the same size as the first inner diameter $Y_1$. However, according to some embodiments, the second inner diameter may be greater than both the first and third inner diameters, and the third inner diameter may be greater than or less than the first inner diameter. Alternatively, a sleeve may have a second inner diameter (larger than the first inner diameter) extend from the first inner diameter to a third inner diameter, wherein the third inner diameter is larger than the second inner diameter.

Figure 11:
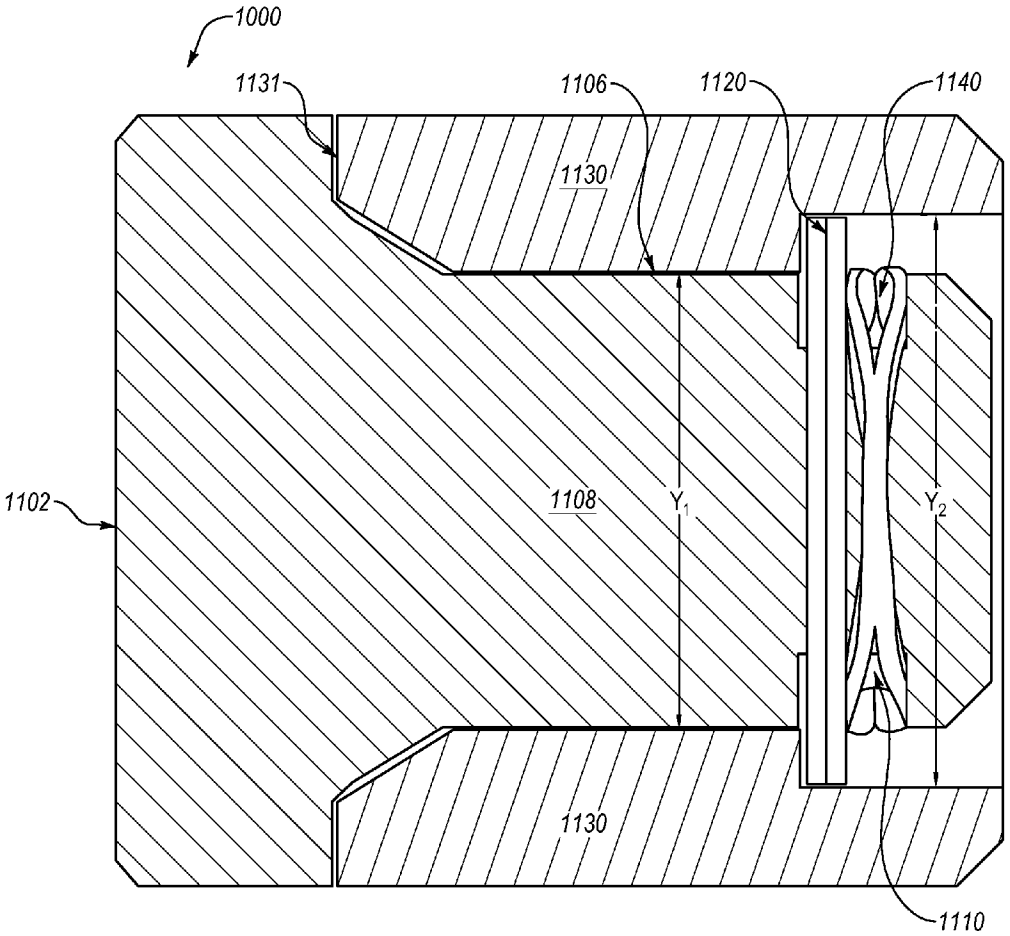
FIG. 11 shows a cross-sectional view of a cutting element according to embodiments of the present disclosure.
Figure 12:
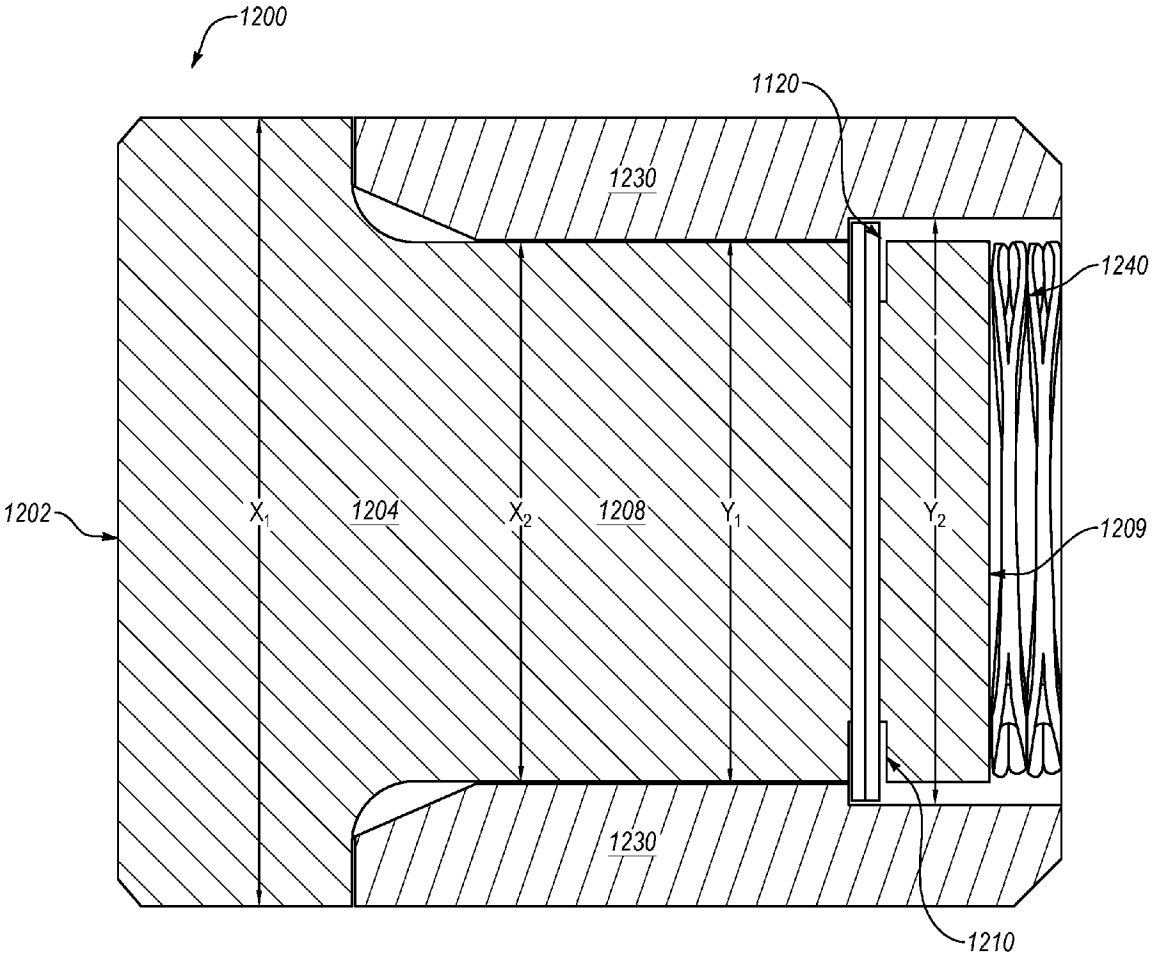
FIG. 12 shows a cross-sectional view of a cutting element according to embodiments of the present disclosure.

Referring again to FIG. 10, the circumferential groove 1010 is formed around the shaft 1008 portion of the rolling cutter 1000 and axially aligns with the larger second inner diameter $Y_2$ of the sleeve 1030, adjacent to the first inner diameter $Y_1$ of the sleeve 1030. As shown, the spring 1040 is positioned adjacent to the retaining ring 1020 within the circumferential groove 1010, wherein the spring 1040 is axially upward (i.e., closer to the cutting face 1002) from the retaining ring 1020. However, according to other embodiments, a spring may be positioned axially downward from the retaining ring, such as shown in FIGS. 11 and 12, for example, described below. Further, the retaining ring 1020 may include a planar closed loop ring having unattached ends so that the retaining ring 1020 may be radially compressed or tightened.

As shown, the spring 1040 may protrude from the circumferential groove 1010 farther than the retaining ring 1020. Alternatively, a spring may protrude from the circumferential groove a distance equal to or smaller than the distance the retaining ring protrudes from the circumferential groove. The cutting element in FIG. 10 has a spring 1040 that protrudes farther than the retaining ring 1020 (in uncompressed form) from the circumferential groove 1010, wherein the spring 1040 contacts the second inner diameter $Y_2$ of the sleeve 1030 while the retaining ring 1020 does not extend completely to the second inner diameter $Y_2$. In such embodiments, the cutting element may be assembled by inserting the spring 1040 into the sleeve 1030 through the bottom 1035 sleeve opening having the larger second inner diameter $Y_2$. The rolling cutter 1000 and the retaining ring 1020 (disposed in the circumferential groove 1010) may then be inserted into the sleeve 1030 through the first inner diameter $Y_1$. Particularly, the retaining ring 1020 is radially compressed to fit through the first inner diameter $Y_1$ and the spring 1040. Once the retaining ring 1020 is through the first inner diameter $Y_1$ and the spring 1040, the retaining ring 1020 may expand to its original size, wherein the retaining ring 1020 protrudes from the circumferential groove 1010 a distance farther than the inner diameter of the spring 1040, thereby retaining the spring 1040 and the rolling cutter 1000 within the sleeve 1030.

FIG. 11 shows a cutting element according to embodiments of the present disclosure having a spring positioned axially downward from a retaining ring and within a circumferential groove. Particularly, the cutting element has a rolling cutter 1100 partially disposed within a sleeve 1130, wherein a retaining ring 1120 and a spring 1140 are disposed between the rolling cutter 1100 and the sleeve 1130. The spring 1140 is positioned axially downward from the retaining ring 1120 and within a circumferential groove 1110 formed around the outer surface of a shaft 1108 portion of the rolling cutter 1100. As shown, the spring 1140 may include two non-planar rings attached together, while the retaining ring 1120 may be a planar closed loop ring, such as described above. However, in other embodiments, different combinations of springs and closed loop retaining rings described herein may be used to retain the rolling cutter within the sleeve.

Further, as shown, the retaining ring 1120 and the spring 1140 may extend different distances from within the circumferential groove 1110. For example, the spring 1140 may radially extend the depth of the circumferential groove 1110 to the outer surface 1106 of the shaft 1108, such that the spring 1140 may fit through a smaller first inner diameter $Y_1$ of the sleeve 1130, while the retaining ring 1120 (in expanded form) may protrude from the circumferential groove 1110 a distance farther than the spring 1140 to contact a larger second inner diameter $Y_2$ of the sleeve 1130. However, according to some embodiments, a retaining ring (in expanded form) may protrude from the circumferential groove a distance farther than the spring without contacting the larger second inner diameter of the sleeve.

According to embodiments of the present disclosure, a cutting element such as the one shown in FIG. 11 may be assembled by positioning a retaining ring 1120 and a spring 1140 within a circumferential groove 1110 formed in a shaft 1108 portion of a rolling cutter 1100, wherein the retaining ring may be positioned axially upward (i.e., closer to the cutting face of the rolling cutter) from the spring 1140. The retaining ring 1120 may be radially compressed so that the shaft 1108, spring 1140, and radially compressed retaining ring 1120 may fit through the first inner diameter $Y_1$ of the sleeve 1130. Upon reaching the larger second inner diameter $Y_2$, the retaining ring 1120 may expand back to its original size, thereby retaining the rolling cutter 1100 within the sleeve 1130.

Referring now to FIG. 12 a cutting element according to another embodiment of the present disclosure is shown, having a spring positioned axially downward from a retaining ring. As shown, a rolling cutter 1200 is disposed within a sleeve 1230, and a retaining ring 1220 is disposed between the rolling cutter 1200 and sleeve 1230, within a circumferential groove 1210 formed around the shaft 1208 portion of the rolling cutter 1200. The sleeve 1230 has a first inner diameter $Y_1$ and a second inner diameter $Y_2$, wherein the second inner diameter $Y_2$ is larger than the first inner diameter $Y_1$ and axially downward from the first inner diameter $Y_1$. The rolling cutter 1200 has a cutting face 1202 and a body 1204 extending axially therefrom, wherein the body 1204 includes a portion having a first diameter $X_1$ and a shaft 1208 portion having a second diameter $X_2$, smaller than the first diameter $X_1$. The retaining ring 1220 has an outer diameter larger than the shaft second diameter $X_2$, such that the retaining ring 1220 protrudes from the circumferential groove 1210 to contact the second inner diameter $Y_2$ of the sleeve 1230, thereby retaining the rolling cutter 1200 within the sleeve 1230. However, in other embodiments, the retaining ring 1220 may radially extend farther than the shaft second diameter $X_2$ without contacting the second inner diameter of the sleeve.

The spring 1240 shown in FIG. 12 may be positioned axially downward from the retaining ring 1220 and axially downward from the rolling cutter 1200. Particularly, the spring 1240 may be adjacent to the bottom surface 1209 of the rolling cutter 1200 and within the sleeve 1230. Further, the spring 1240 may be formed of two or more non-planar closed loop rings, as discussed above, or may be other types of springs known in the art.

Advantageously, by using one or more springs with a rolling cutter partially disposed in a sleeve, appropriate contact along the axial bearings between the rolling cutter and sleeve top opening may be maintained to prevent debris from entering between the rolling cutter and sleeve. Particularly, axial bearings within cutting elements of the present disclosure may refer to the interfacing surfaces of the portion of the rolling cutter that is outside the sleeve and the top surface of the sleeve opening. For example, as shown in FIGS. 10 and 11, interfacing surfaces between the portion of the rolling cutter body 1004, 1104 outside the sleeve 1030, 1130 and the top surface 1031, 1131 of the sleeve 1030, 1130 may form axial bearings. The spring 1040, 1140 may exert a downward axial force from within the circumferential groove on the rolling cutter to maintain contact between the portion of the rolling cutter body 1004, 1104 outside the sleeve 1030, 1130 and the top surface 1031, 1131 of the sleeve 1030, 1130. Maintaining contact between the rolling cutter and the top surface of a sleeve opening may prevent or reduce debris from entering between the rolling cutter and sleeve, thereby reducing wear of the interfacing surfaces and thus failure of the cutting element.

Additionally, a spring may improve rotatability of the rolling cutter within the sleeve. For example, as shown in FIG. 12, a spring may be positioned axially downward from the rolling cutter and within the sleeve. During drilling operations, forces resulting from cutting action between the formation being drilled and the cutting element may inhibit rotation of the rolling cutter within the sleeve. Advantageously, positioning a spring axially downward from the rolling cutter may help to counter the forces preventing rotation. For example, junk or other debris that may enter into the gap between the sleeve and rolling cutter may act to bond the sleeve and rolling cutter together and inhibit rotating motion. By having a spring always pushing the rolling cutter forward, drilling actions will create axial movements that may break loose the rolling cutter and sleeve, and thereby improve rotatability of the rolling cutter within the sleeve.

Springs used in the present disclosure may have varying values of compressibility. For example, a spring may have a spring constant ranging from a lower limit of any of 10 lb/in, 30 lb/in, and 50 lb/in to an upper limit of any of 50 lb/in, 70 lb/in, 100 lb/in, or greater than 100 lb/in, where any lower limit can be used in combination with any upper limit Further, springs may be made of the same material as a retaining ring, or a different material than a retaining ring. For example, springs may be made of a metal, alloys, composite materials, stainless steels, or other material capable of withstanding wear and corrosion.

Furthermore, the sleeves shown in FIGS. 8 and 10-12 are shown in a cross-sectional, cutaway view, while the rolling cutters are shown in a side view. However, it should be noted that the sleeves may extend continuously around the shaft portion of a rolling cutter, having only a top and bottom opening formed within the sleeve. For example, FIGS. 4 and 13 show a perspective view of a sleeve 330, 1330, wherein the outer surface of the sleeve is continuous.

Figure 13:
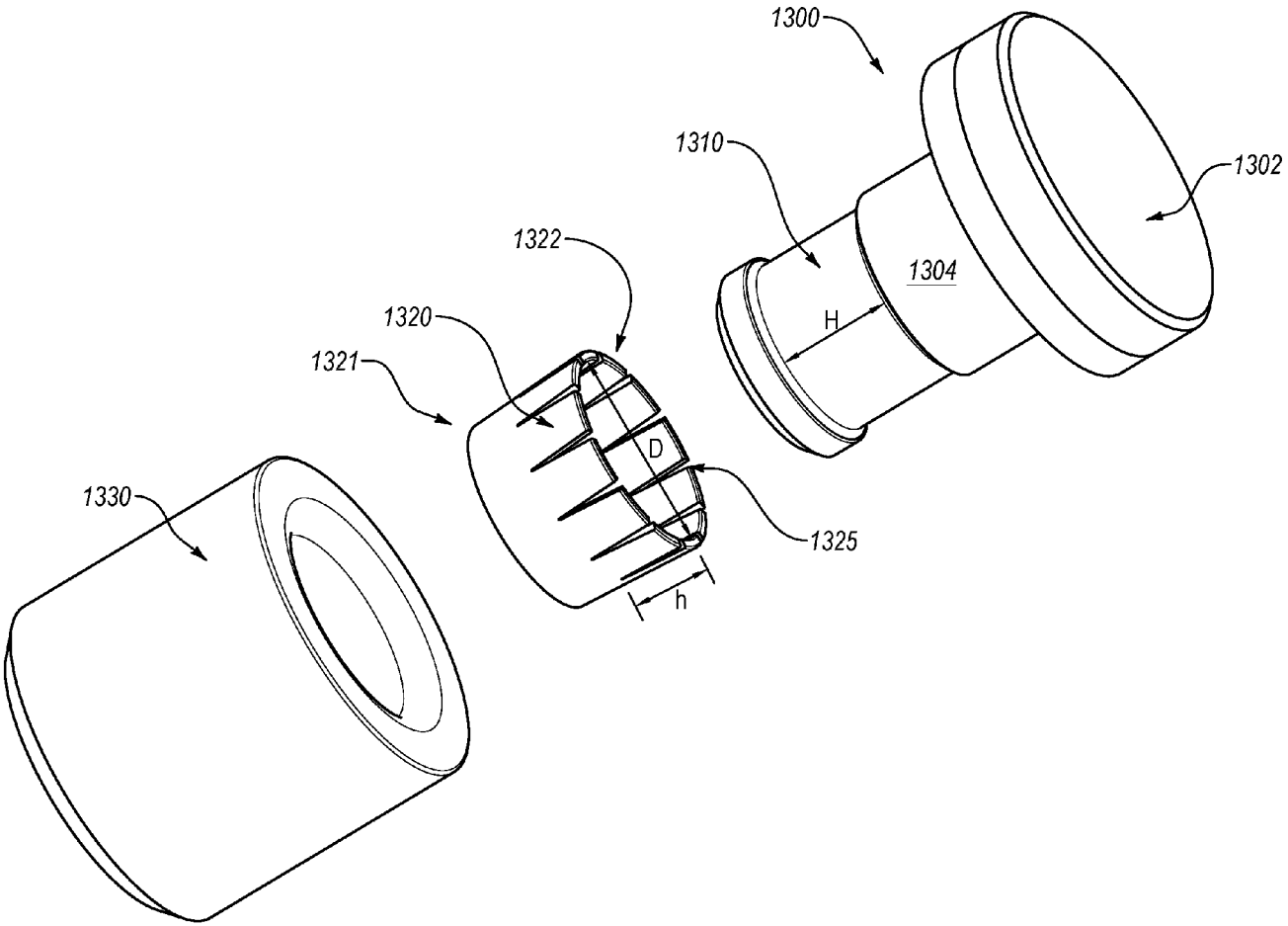
FIG. 13 shows an exploded view of a cutting element according to embodiments of the present disclosure.

Referring now to FIG. 13, an exploded view of a cutting element according to embodiments of the present disclosure is shown. The cutting element includes a rolling cutter 1300, a retaining ring 1320, and a sleeve 1330. The rolling cutter 1300 has a cutting face 1302 and a body 1304 extending therefrom. Particularly, the cutting face 1302 may be formed from a diamond or other ultrahard material table 1305. A circumferential groove 1310 is formed around the outer surface of the body 1304, wherein the circumferential groove 1310 extends an axial height H along the body 1304. The retaining ring 1320 is a closed loop ring and has slits 1325 spaced around the retaining ring 1320, extending axially through a partial height h of the retaining ring 1320. For example, the slits 1325 may be equally or unequally spaced around the retaining ring 1320. Further, the retaining ring 1320 has a diameter D that changes along its height. For example, the diameter D may gradually increase along the partial height h of the slits 1325, from a bottom end 1321 to a top end 1322.

Figure 14:
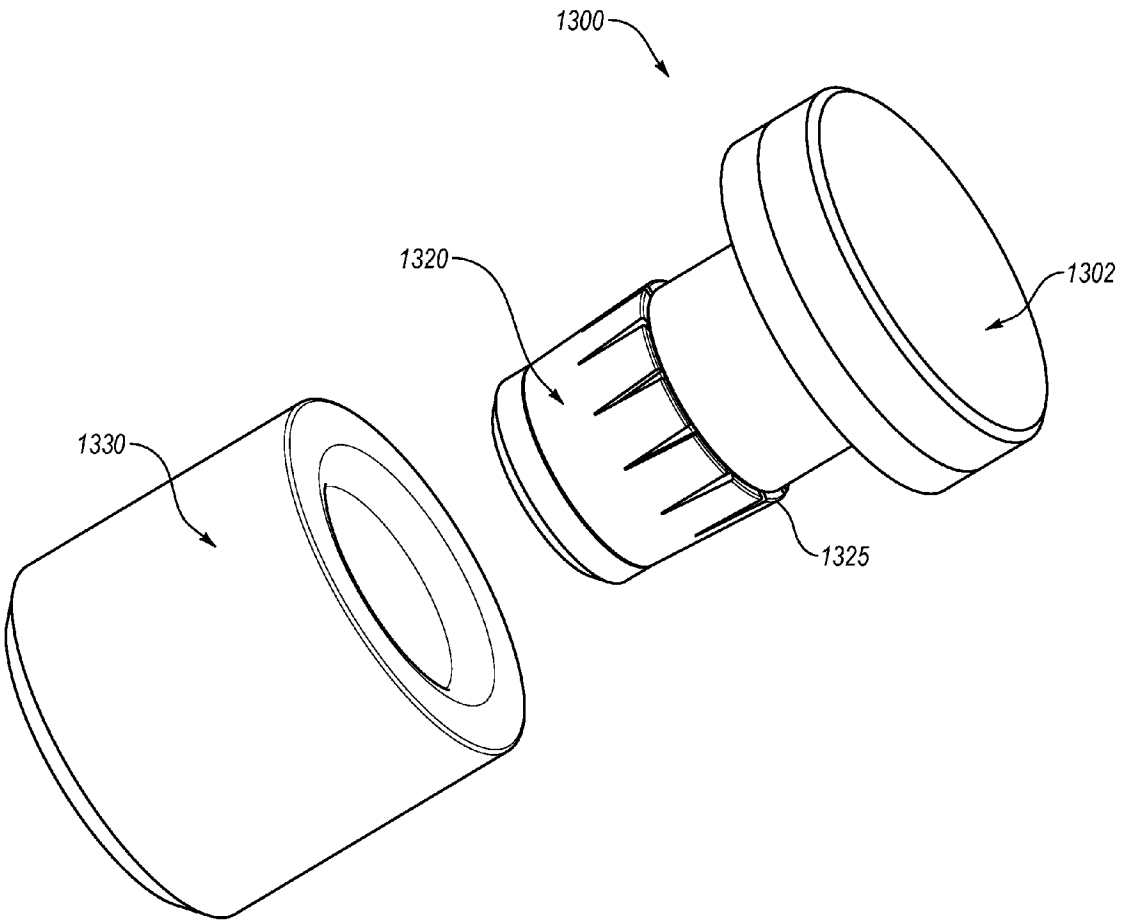
FIG. 14 shows a perspective view of a cutting element according to embodiments of the present disclosure.
Figure 15:
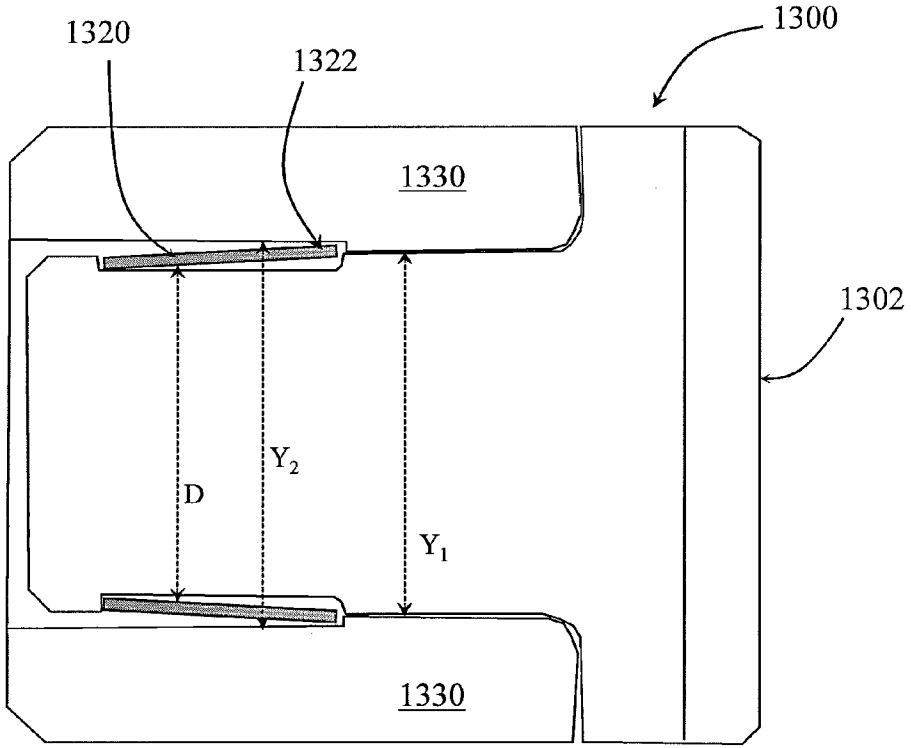
FIG. 15 shows a cross-sectional view of a cutting element according to embodiments of the present disclosure.

FIG. 14 shows a perspective view of the cutting element shown in FIG. 13 partially assembled, wherein the retaining ring 1320 is positioned within the circumferential groove 1310. As shown, the slits 1325 extend radially outward from the outer surface of the rolling cutter 1300 and axially towards the cutting face 1302. FIG. 15 shows a cross-sectional view of the cutting element shown in FIGS. 13 and 14 as assembled. As shown, the rolling cutter 1300 is disposed within the sleeve 1330, and the retaining ring 1320 is disposed within the circumferential groove 1310 between the rolling cutter 1300 and the sleeve 1330. The sleeve 1330 has a first inner diameter $Y_1$ and a second inner diameter $Y_2$, wherein the second inner diameter $Y_2$ is larger than the first inner diameter $Y_1$. The retaining ring 1320 has a gradually increasing diameter D such that the top end 1322 of the retaining ring 1320 protrudes a distance from the circumferential groove 1310 to contact the larger second inner diameter $Y_2$ of the sleeve 1330, thereby retaining the rolling cutter 1300 within the sleeve 1330.

The slits 1325 formed in the retaining ring 1320 may provide the retaining ring 1320 with spring action. Particularly, by providing slits 1325 axially along a partial height h of the retaining ring 1320, the retaining ring 1320 may act as a spring, which may be radially compressed and spring radially outward along the partial height h of the slits 1325. Advantageously, by extending radially outward to contact the larger inner diameter $Y_2$ of the sleeve 1330, the retaining ring 1320 may axially maintain the rolling cutter 1300 tight against the sleeve 1330, which may reduce or prevent debris from entering between the rolling cutter 1300 and the sleeve 1330, while also radially maintaining the rolling cutter 1300 within the center of the sleeve 1330.

Figure 20:
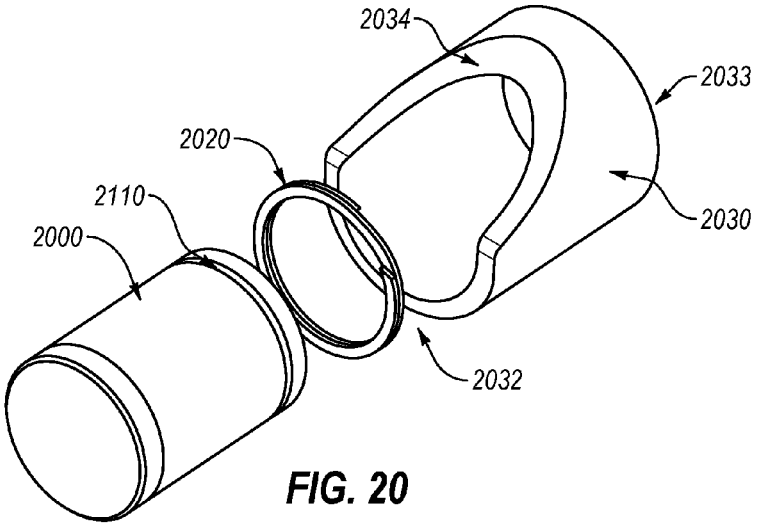
FIG. 20 shows an exploded view of a cutting element assembly according to embodiments of the present disclosure.
Figure 21:
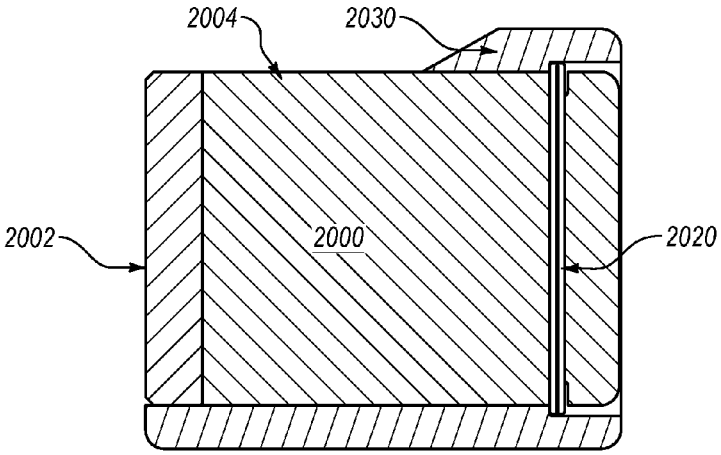
FIG. 21 shows a cross-sectional view of a cutting element assembly according to embodiments of the present disclosure.
Figure 22:
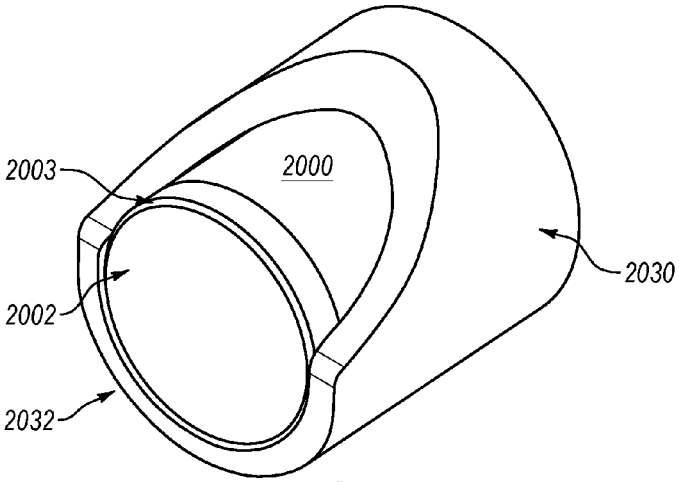
FIG. 22 shows a perspective view of a cutting element assembly according to embodiments of the present disclosure.

Referring now to FIGS. 20-22, a cutting element assembly according to other embodiments of the present disclosure is shown. Particularly, FIG. 20 shows an exploded view of a cutting element assembly having a rolling cutter 2000, a sleeve 2030, and a retaining ring 2020. The sleeve 2030 has a substantially cylindrical shape with a cut-out 2034 portion extending axially downward from a cutting face end 2032 of the sleeve 2030 towards the opposite end 2033 of the sleeve 2030. The cut-out 2034 may be sized according to the size and position of the rolling cutter 2000 in assembled form in order to expose a cutting edge of the rolling cutter. For example, as shown in FIG. 22, the sleeve 2030 may extend to substantially the same height as the rolling cutter 2000, so that the cutting end face 2032 of the sleeve 2030 is at substantially the same height as the cutting face 2002 of the rolling cutter. The cut-out 2034 may extend around up to about half the circumference of the sleeve 2030 and axially downward up to about ¾ the length of the sleeve 2030, thereby exposing a cutting edge 2003 of the rolling cutter 2000 as assembled. However, in other embodiments, a cut-out may extend around more or less than half the circumference of the sleeve and more or less than ¾ the length of the sleeve. A cross-section of the assembled cutting element is shown in FIG. 21, wherein the rolling cutter 2000 is partially disposed within a sleeve 2030, and a retaining ring 2020 is disposed between the rolling cutter 2000 and the sleeve 2030. Particularly, the rolling cutter 2000 has a cutting face 2002 and a body 2004 extending axially downward from the cutting face 2002. The body 2004 has a circumferential groove 2010 formed around the outer surface of the body 2004. The retaining ring 2020 is disposed within the circumferential groove 2010 between the rolling cutter 2000 and the sleeve 2030 to retain the rolling cutter 2000 within the sleeve 2030.

Each of the embodiments described herein may have at least one ultra hard material included therein. Such ultra hard materials may include a conventional polycrystalline diamond table (a table of interconnected diamond particles having interstitial spaces therebetween in which a metal component (such as a metal catalyst) may reside), a thermally stable diamond layer (i.e., having a thermal stability greater than that of conventional polycrystalline diamond, 750° C.) formed, for example, by removing substantially all metal from the interstitial spaces betweens interconnected diamond particles or from a diamond/silicon carbide composite, or other ultra hard material such as a cubic boron nitride or any other super hard material including different carbides. For example, according to some embodiments, an ultra hard material table, such as polycrystalline diamond, may be used to form the cutting face and cutting edge of a rolling cutter. Further, in particular embodiments, various grades of diamond may be used, such as varying particle sizes or diamond density.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table. To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate, or rolling cutter body, on which the cutting face is disposed may be formed of a variety of hard and/or ultra hard particles. In one embodiment, the body may be formed from a suitable material such as tungsten carbide, tantalum carbide, or titanium carbide. Additionally, various binding metals may be included in the body, such as cobalt, nickel, iron, metal alloys, or mixtures thereof. In the body, the metal carbide grains are supported within the metallic binder, such as cobalt. Additionally, the body may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the body may also include a diamond ultra hard material such as polycrystalline diamond and thermally stable diamond. One of skill in the art should appreciate that it is within the scope of the present disclosure the cutting face and body are integral, identical compositions. Rolling cutters having an integral cutting face and body formed of identical compositions are shown, for example, in FIGS. 8, 11 and 12. Rolling cutters having multiple compositions, such as an ultra hard material, e.g., diamond, form the cutting face and different hard material, e.g., tungsten carbide, form the body are shown, for example, in FIGS. 4, 5, 10 and 13-15.

Further, the sleeve may be formed from a variety of materials. In one embodiment, the sleeve may be formed of a suitable material such as tungsten carbide, tantalum carbide, or titanium carbide. Additionally, various binding metals may be included in the sleeve, such as cobalt, nickel, iron, metal alloys, or mixtures thereof, such that the metal carbide grains are supported within the metallic binder. In a particular embodiment, the sleeve is a cemented tungsten carbide with a cobalt content ranging from 6 to 13 percent. It is also within the scope of the present disclosure that the sleeve may also include more lubricious materials to reduce the coefficient of friction. The sleeve may be formed of such materials in its entirety or have a portions thereof (such as the inner surface) including such lubricious materials. For example, the sleeve may include diamond, diamond-like coatings, or other solid film lubricant. In other embodiments, the sleeve may be formed of alloy steels, nickel-based alloys, cobalt-based alloys, and/or high speed cutting tool steels.

Cutting elements of the present disclosure may be attached to a drill bit or other downhole cutting tool by attaching the sleeve of the cutting element to a cutter pocket formed in the tool by methods known in the art, such as by brazing. For example, a drill bit may have a bit body, a plurality of blades extending from the bit body, wherein each blade has a leading face, a trailing face, and a top side, and a plurality of cutter pockets disposed in the plurality of blades. According to some embodiments, blades may be formed of a boride, nitride, or carbide matrix material, such as a matrix material made of tungsten carbide and a binder, such as a metal from Group VIII of the Periodic Table. In some embodiments, the blades may also be impregnated with an ultra hard material, such as diamond. The cutter pockets may be formed in the top side of a blade, at the leading face, so that the cutting elements may contact and cut the working surface once disposed in the cutter pockets. A sleeve of a cutting element according to embodiments disclosed herein may be attached to one of the cutter pockets with or without a rotatable cutting element disposed therein. The sleeve may be attached to a bit body using a brazing process known in the art. Alternatively, in other embodiments of the present disclosure, a sleeve may be infiltrated or cast directly into the bit body during an infiltration or sintering process. The sleeve may have a first inner diameter and a second inner diameter, wherein the second inner diameter is larger than the first inner diameter.

As discussed above, a rotatable cutting element (inserted within the sleeve either before or after attachment to a cutter pocket), having an axis of rotation extending therethrough, may have a cutting face, a body extending downwardly from the cutting face, an outer surface, and a cutting edge formed at the intersection of the cutting face and the outer surface. A circumferential groove may be formed in the outer surface of the rotatable cutting element body, and at least one retaining ring may be disposed in the circumferential groove. The at least one retaining ring may protrude from the circumferential groove to contact the second inner diameter of the sleeve, thereby retaining the rotatable cutting element within the sleeve. Further, once attached to a blade, the cutting face of the rotatable cutting element may be flush with the leading face of the blade.

Figure 16:
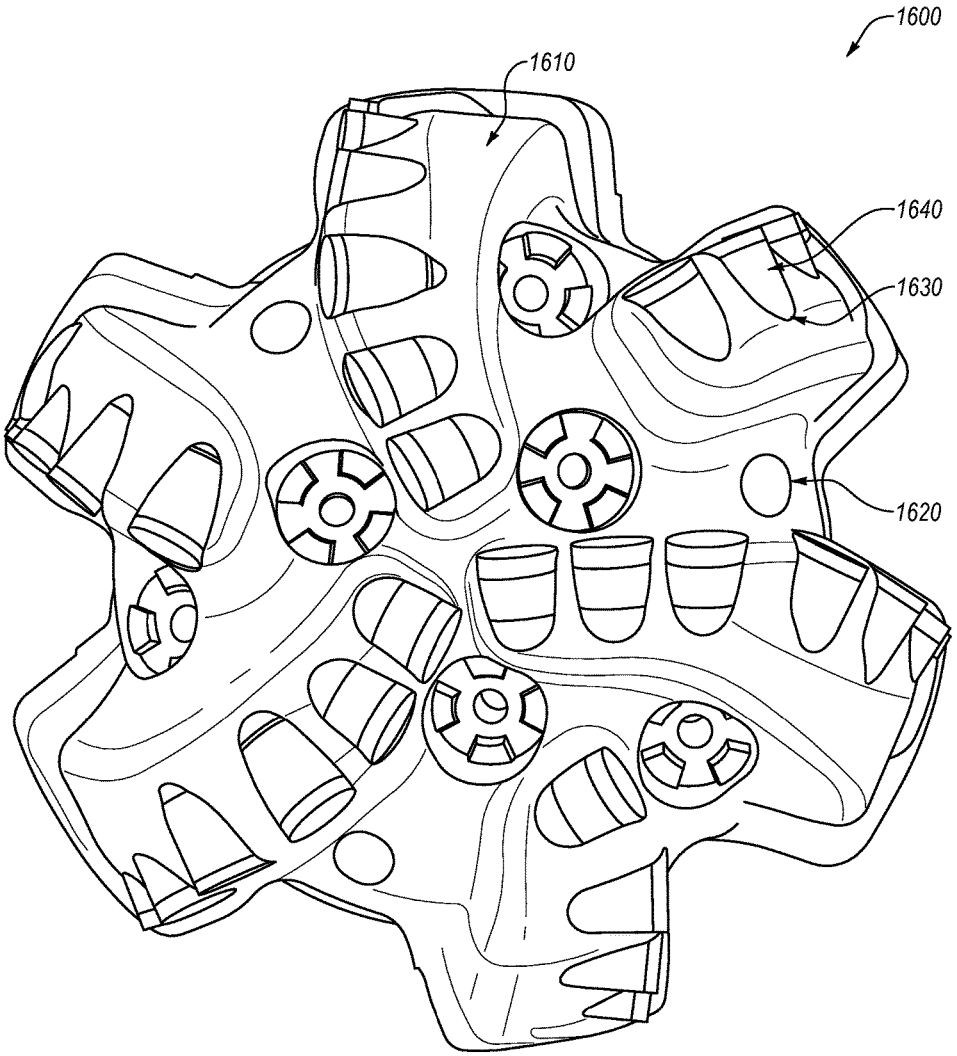
FIG. 16 shows a top view of a drill bit according to embodiments of the present disclosure.
Figure 17:
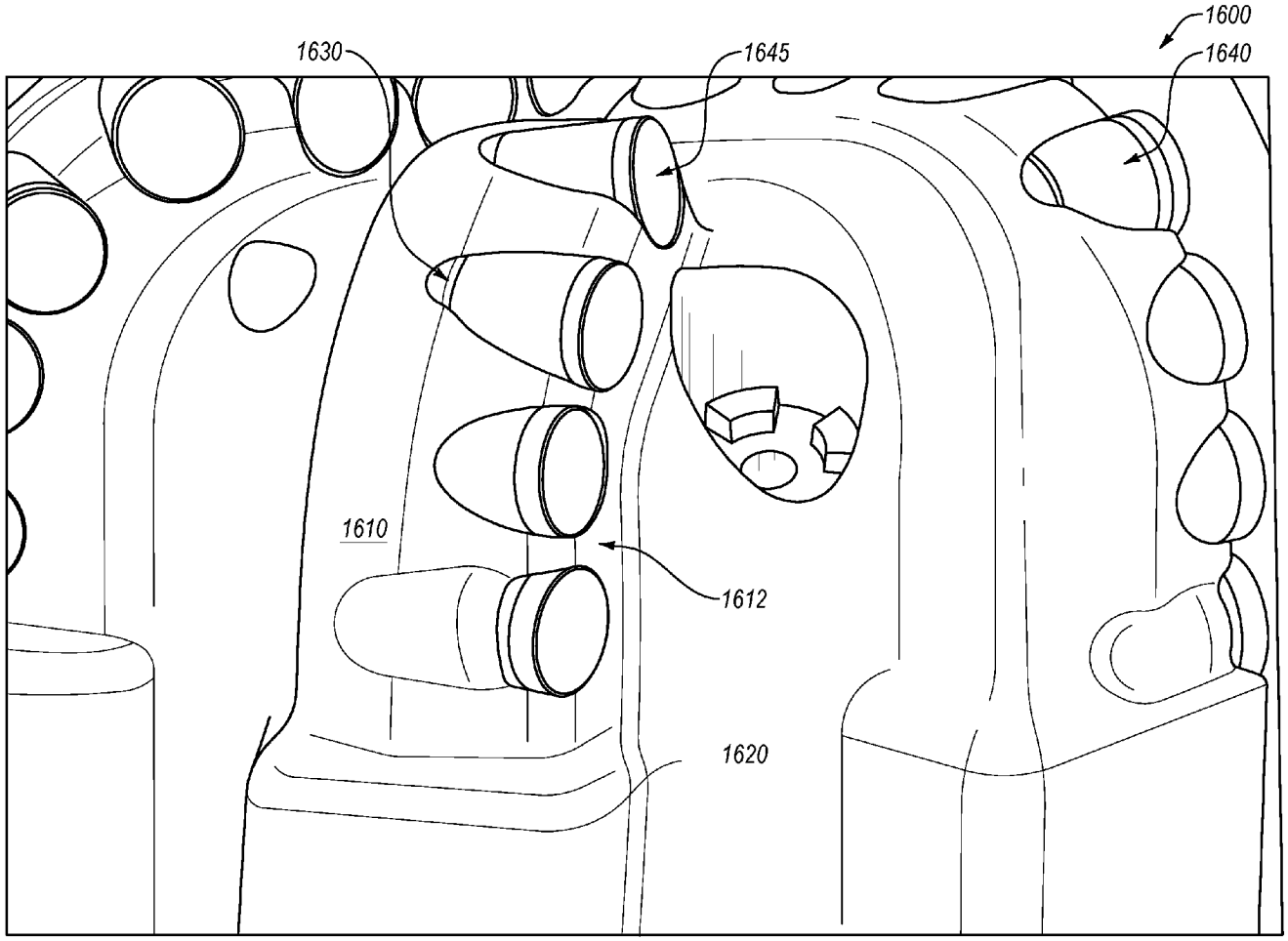
FIG. 17 shows a side view of a drill bit according to embodiments of the present disclosure.

For example, referring to FIGS. 16 and 17, a top view and a partial side view, respectively, of a drill bit 1600 according to embodiments of the present disclosure are shown. The drill bit 1600 has a plurality of blades 1610 extending from a bit body 1620, wherein each blade 1610 has a leading face 1612 facing in the direction of the bit rotation. A plurality of cutter pockets 1630 are formed in the blades 1610 at the leading face 1612. Cutting elements 1640 according to embodiments of the present disclosure may be positioned within the cutter pockets 1630 so that the cutting face 1645 of the cutting element 1640 is flush with the leading face 1612 of the blade 1610. The cutting elements 1640 may be secured within the cutter pockets 1630 by attaching the cutting element sleeves to the cutter pockets using attachment methods known in the art, for example, brazing.

Figure 23:
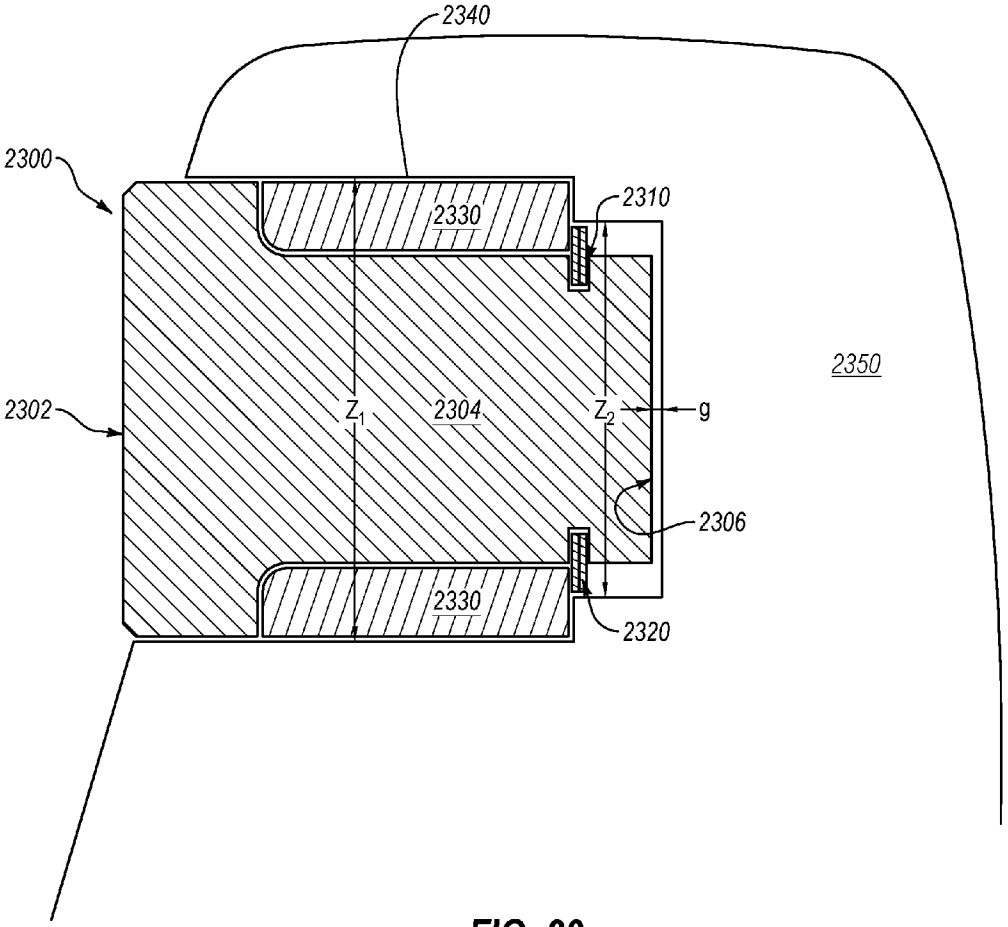
FIG. 23 shows a cross-sectional view of a cutting element assembly according to embodiments of the present disclosure.

FIG. 23 shows another embodiment of a cutting element assembly attached within a blade of a cutting tool. The cutting element assembly includes a sleeve 2330 and a rotatable cutting element 2300 having a cutting face 2302 and a body 2304 extending axially downward from the cutting face 2302, wherein at least a portion of the body 2304 is disposed within the sleeve 2330. A circumferential groove 2310 is formed around an outer surface of the body 2304, wherein the circumferential groove 2310 is located axially downward from the sleeve 2330. At least one retaining ring 2320 is disposed in the circumferential groove 2310, wherein the retaining ring 2320 extends at least around the entire circumference of the body 2304 and protrudes from the circumferential groove 2310, thereby retaining the rotatable cutting element within the sleeve. The cutting element assembly is disposed in a corresponding pocket 2340 formed in a blade 2350 of a cutting tool, such as a drill bit. For example, the sleeve 2330 may be brazed to the pocket 2340 by brazing methods known in the art, and then the rotatable cutting element 2300 may be inserted into the sleeve 2330. The pocket 2340 has a first inner diameter $Z_1$ and a second inner diameter $Z_2$, wherein the second inner diameter $Z_2$ is smaller than the first inner diameter $Z_1$. The sleeve 2330 of the cutting element assembly is disposed within the first inner diameter $Z_1$ and the retaining ring 2320 is disposed within the second inner diameter $Z_2$. As shown, the sleeve 2330 may be positioned adjacent to both the retaining ring 2320 and the transition between the first and second inner diameters of the blade pocket 2340, thus holding the rotatable cutting element 2300 within the pocket 2340. Further, a bottom face 2306 of the rotatable cutting element 2300 may be spaced from the cutter pocket 2340 a distance g. In one or more embodiments, g may be at least 0.003 inches or may be at least 0.005, 0.008, or 0.012 inches in various other embodiments. Such distance may advantageously allow for minimization of frictional forces during rotation of the cutting element (and thus allowing for rotatability) as well as reduce or minimize bending loads on the shoulder of the cutting element. Such distance may be present in any of the embodiments disclosed herein, regardless of sleeve height relative to cutter height.

The cutting elements of the present disclosure may be incorporated in various types of cutting tools, including for example, as cutters in fixed cutter bits or in reamers, or in other earth-boring tools. Bits having the cutting elements of the present disclosure may include a single rotatable cutting element with the remaining cutting elements being conventional cutting elements, all cutting elements being rotatable, or any combination therebetween of rotatable and conventional cutting elements.

In some embodiments, the placement of the cutting elements on the blade of a fixed cutter bit or cone of a roller cone bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that various side rakes and back rakes may be used in various combinations. For example, in one embodiment, cutter side rakes may range from about −30 to +35 degrees, and cutter back rakes may range from about 5 to 60 degrees. A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments because the radial direction may assist the movement of rolling cutter relative to sleeve, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

As a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

Furthermore, by using closed loop retaining rings of the present disclosure to retain the rolling cutter within the sleeve, the life of the cutting element may be improved. Particularly, the closed loop retaining rings of the present disclosure may provide uniform loading between the rolling cutter and the sleeve (e.g., at the transition between the sleeve smaller inner diameter and larger inner diameter or the interfacing surface with the retaining ring). Additionally, using a closed loop retaining ring, as described herein, may improve rotatability of the rolling cutter within the sleeve, as the closed loop ring has a continuous surface to rotate about.

Figure 18B:
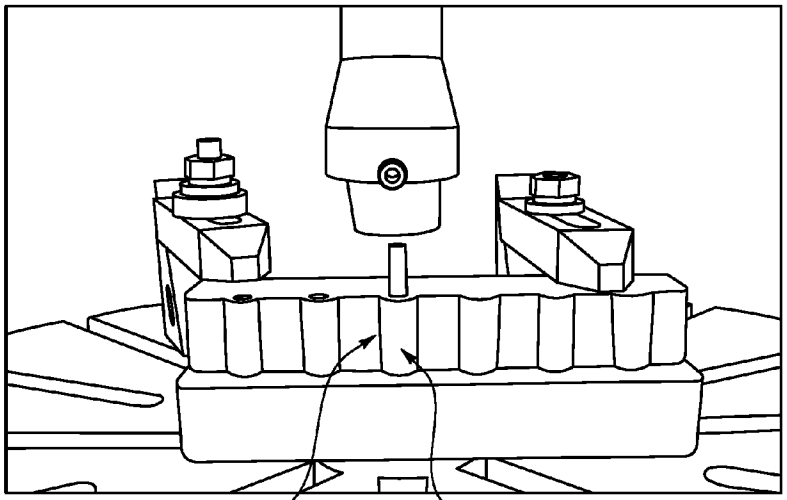
FIGS. 18A and 18B show pictures of cutting elements according to embodiments of the present disclosure for lab testing.
Figure 18A:
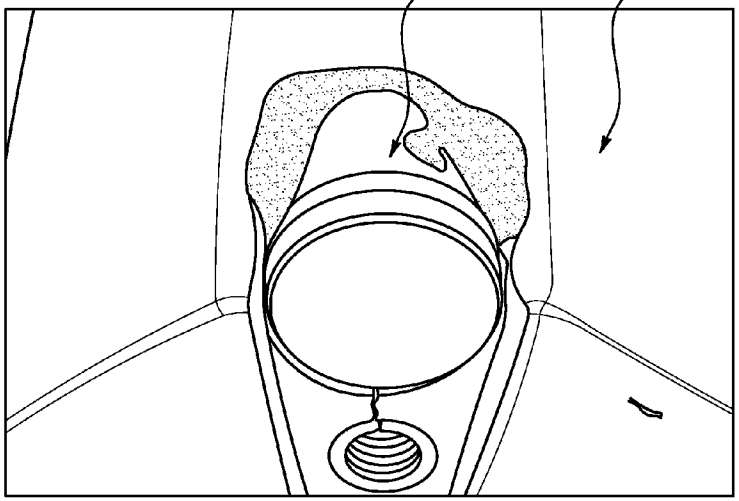

Referring now to FIGS. 18A and 18B, tests were conducted in the lab to test retention and performance of cutting elements 1800 according to embodiments of the present disclosure. In the lab tests, cutting elements of the present disclosure were attached to a support element 1850 and subjected to forces similar to that experienced during drilling, for example, push out forces, shear and impact forces. When compared to rotatable cutting elements that do not have closed loop retention rings, the cutting elements of the present disclosure showed improved cutting element retention and performance.

Furthermore, cutting elements of the present disclosure may be modified to be fixed, for example by brazing the rolling cutter to the sleeve, or may be modified to be indexable. For example, a rolling cutter shaft and corresponding inner shape of a sleeve may be modified to be non-cylindrical and axisymmetrical, such that the rolling cutter may be manually removed from the sleeve and rotated an increment about the axis. Embodiments having a non-cylindrical and axisymmetrical rolling cutter and corresponding sleeve may be indexable, for example, by 20°, 45°, 90°, 120°, or other incremental amounts less than 360°.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:
a bit body;
a plurality of blades extending from the bit body; and
at least one cutting element assembly disposed on at least one of the plurality of blades and including:
a sleeve, comprising:
a first inner diameter ($Y_1$); and
a second inner diameter, wherein the second inner diameter is larger than the first inner diameter and located at a lower axial position than the first inner diameter;
a rotatable cutting element having an axis of rotation extending therethrough, wherein the rotatable cutting element comprises:
a cutting face and a body extending axially downward from the cutting face, wherein at least a portion of the body is disposed within the sleeve; and
a circumferential groove formed around an outer surface of the portion of the body; and
at least one retaining ring of a ring material and disposed in the circumferential groove, the at least one retaining ring having a radial wall width (h);
wherein the at least one retaining ring extends at least around the entire circumference of the portion of the body;
wherein the at least one retaining ring protrudes from the circumferential groove, thereby retaining the rotatable cutting element within the sleeve; and
wherein the radial wall width (h) of an uncompressed diameter (f) of the at least one retaining ring is related to the first diameter of the sleeve ($Y_1$) according to the relationship: $E\,h(f-Y_1)/((f-h)(Y_1-h))\leq S_y$, where E is a modulus of elasticity of the ring material and $S_y$ is a yield strength of the ring material.

2. The drill bit of claim 1, wherein the portion of the body comprises a shaft, and wherein the shaft is disposed within the sleeve.

3. The drill bit of claim 1, wherein the retaining ring extends around the circumference greater than 1.5 times the circumference of the portion of the body.

4. The drill bit of claim 1, further comprising a spring.

5. The drill bit of claim 4, wherein the spring is disposed axially downward from the retaining ring and within the circumferential groove.

6. The drill bit of claim 4, wherein the spring is disposed axially upward from the retaining ring and within the circumferential groove.

7. The drill bit of claim 4, wherein the spring is disposed axially downward from the body and disposed within sleeve.

8. The drill bit of claim 4, wherein the spring comprises at least one non-planar retaining ring.

9. The drill bit of claim 1, wherein the retaining ring is non-planar.

10. The drill bit of claim 1, wherein the retaining ring is axially compressible.

11. The drill bit of claim 1, wherein the retaining ring comprises a plurality of slits, each of the plurality of slits extending axially from a same end portion of the retaining ring and through a partial height of the retaining ring.

12. The drill bit of claim 11, wherein the plurality of slits are equally spaced around the circumference of the retaining ring.

13. The drill bit of claim 1, wherein the cutting face comprises polycrystalline diamond.

14. The drill bit of claim 1, further comprising a second circumferential groove formed around the outer surface of the body and a second retaining ring disposed within the second circumferential groove.

15. The drill bit of claim 14, the second circumferential groove and second retaining ring being disposed within the sleeve.

16. The drill bit of claim 1, wherein the entire cutting face of the cutting element is flush with a leading face of the blade.

17. The drill bit of claim 1, wherein the retaining ring comprises unattached and overlapping ends.

18. The drill bit of claim 1, wherein the retaining ring comprises a gradually increasing diameter along the axial height of the body.

19. The drill bit of claim 1, wherein the sleeve comprises a gradually increasing inner diameter extending from the first inner diameter to a top opening of the sleeve.

20. The drill bit of claim 1, wherein the sleeve further comprises a third inner diameter smaller than the second inner diameter and located at a lower axial position than the second inner diameter.

21. The drill bit of claim 1, wherein at least a portion of the cutting face is flush with a leading face of the at least one of the plurality of blade.

22. A drill bit comprising:
a bit body;
a plurality of blades extending from the bit body;
at least one cutting element assembly disposed in a corresponding pocket formed in a blade, the at least one cutting element assembly including:
a sleeve;
a rotatable cutting element having an axis of rotation extending therethrough, wherein the rotatable cutting element comprises:
a cutting face and a cutting element body extending axially downward from the cutting face, wherein at least a portion of the cutting element body is disposed within the sleeve; and a circumferential groove formed around an outer surface of the cutting element body, wherein the circumferential groove is located axially downward from the sleeve; and at least one retaining ring disposed in the circumferential groove;

wherein the at least one retaining ring extends at least around the entire circumference of the cutting element body; and wherein the at least one retaining ring protrudes from the circumferential groove, thereby retaining the rotatable cutting element within the sleeve;

wherein the corresponding pocket comprises:

a first inner diameter;

a second inner diameter, wherein the second inner diameter is smaller than the first inner diameter; and wherein the sleeve of the cutting element assembly is disposed within the first inner diameter and the retaining ring is disposed within the second inner diameter.

* * * * *